US008701356B2

(12) United States Patent
Forsland et al.

(10) Patent No.: US 8,701,356 B2
(45) **Date of Patent: *Apr. 22, 2014**

(54) STRUCTURE HAVING CONVERTIBLE ROOF AND WALLS

(75) Inventors: Kent Harry Forsland, River Falls, WI (US); Michael Dennis Peters, West Bend, WI (US); Luke Duane Schraw, St. Paul, MN (US)

(73) Assignee: Cabrio Companies LLC, River Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,244

(22) Filed: Jul. 18, 2012

(65) Prior Publication Data

US 2013/0042541 A1 Feb. 21, 2013

Related U.S. Application Data

(63) Continuation of application No. 13/041,237, filed on Mar. 4, 2011, which is a continuation-in-part of application No. PCT/US2011/020977, filed on Jan. 12, 2011.

(60) Provisional application No. 61/294,302, filed on Jan. 12, 2010.

(51) Int. Cl.

| | |
|---|---|
| ***E04B 1/343*** | (2006.01) |
| ***E04B 7/16*** | (2006.01) |
| ***E04B 1/346*** | (2006.01) |

(52) U.S. Cl.

USPC ..... 52/66; 52/64; 52/72; 52/79.5; 4/494

(58) Field of Classification Search

USPC ..... 52/66, 67, 6, 64, 72, 79.5, 68; 4/494

See application file for complete search history.

(56) References Cited

U.S. PATENT DOCUMENTS 1,896,433 A 2/1933 Windeknecht
2,094,801 A * 10/1937 Mass ..... 52/64

(Continued)

FOREIGN PATENT DOCUMENTS

DE 34 24 542 A1 1/1986
EP 147502 A1 * 7/1985

(Continued)

OTHER PUBLICATIONS

Machine Translation for EP 147502 A1 retrieved from Espacenet.com on Aug. 21, 2013 (17 pages).*

(Continued)

*Primary Examiner* — Basil Katcheves
*Assistant Examiner* — Rodney Mintz
(74) *Attorney, Agent, or Firm* — Merchant & Gould P.C.

(57) ABSTRACT

A movable enclosure is configured to selectively enclose an area. The enclosure includes at least one side wall and an end wall attached thereto. The side wall comprises a number of individual panels that are independently movable along a track secured to the ground. The panels are selectively collapsible such that they may travel along the track and overlap one another when in a collapsed or stowed position. The enclosure may be configured in any number of intermediate positions wherein the panels are partially collapsed. Roof panels may be attached to the side walls for movement therewith, or alternatively, the roof panels may operate independent of the side walls to extend and retract between an open and collapsed configuration.

8 Claims, 18 Drawing Sheets

(56) References Cited

U.S. PATENT DOCUMENTS

| | | | | | |
|---|---|---|---|---|---|
| 2,229,908 | A | | 1/1941 | Wenneborg | |
| 2,603,171 | A | * | 7/1952 | Smith | 52/66 |
| 2,895,183 | A | | 7/1959 | Dumbolton | |
| 2,931,468 | A | * | 4/1960 | Keller | 428/46 |
| 3,028,872 | A | | 4/1962 | Cresswell | |
| 3,044,540 | A | * | 7/1962 | Hammersley | 160/20 |
| 3,093,834 | A | | 6/1963 | Watkins | |
| 3,213,571 | A | * | 10/1965 | Olson | 52/66 |
| 3,248,830 | A | | 5/1966 | Maynard | |
| 3,328,926 | A | * | 7/1967 | Reinhard | 52/2.17 |
| 3,333,621 | A | * | 8/1967 | Elder | 160/206 |
| 3,443,265 | A | | 5/1969 | Hauck | |
| 3,462,891 | A | | 8/1969 | Smith | |
| 3,465,483 | A | * | 9/1969 | Miller | 52/72 |
| 3,552,072 | A | * | 1/1971 | O'Connell | 52/2.19 |
| 3,566,555 | A | | 3/1971 | Schultz et al. | |
| 3,589,084 | A | * | 6/1971 | Reed, III | 52/64 |
| 3,608,252 | A | * | 9/1971 | Bisson | 52/19 |
| 3,660,951 | A | * | 5/1972 | Cadwell | 52/2.18 |
| 3,662,410 | A | | 5/1972 | Lankheet | |
| 3,745,725 | A | * | 7/1973 | Boucaud | 52/67 |
| 3,766,691 | A | | 10/1973 | Ray | |
| 3,774,366 | A | * | 11/1973 | Baker | 52/664 |
| 3,815,299 | A | * | 6/1974 | Sorensen et al. | 52/66 |
| 3,845,591 | A | | 11/1974 | Stine | |
| 4,009,796 | A | * | 3/1977 | Schmidt | 220/668 |
| 4,038,788 | A | * | 8/1977 | Claessens | 52/2.17 |
| 4,073,098 | A | * | 2/1978 | Baker | 52/66 |
| 4,175,361 | A | | 11/1979 | Kumode | |
| 4,192,105 | A | * | 3/1980 | Morgan | 52/2.25 |
| 4,245,614 | A | | 1/1981 | Hurwitz et al. | |
| 4,271,644 | A | | 6/1981 | Rilliet | |
| 4,283,889 | A | | 8/1981 | Dunn | |
| 4,301,851 | A | * | 11/1981 | Gitkin | 160/46 |
| 4,312,157 | A | | 1/1982 | Hertel et al. | |
| 4,381,629 | A | * | 5/1983 | Ahn | 52/66 |
| 4,426,744 | A | | 1/1984 | Love | |
| 4,532,743 | A | | 8/1985 | Miller et al. | |
| 4,587,775 | A | * | 5/1986 | Lewis et al. | 52/65 |
| 4,616,451 | A | * | 10/1986 | Glick | 52/66 |
| 4,633,626 | A | | 1/1987 | Freeman et al. | |
| 4,674,241 | A | | 6/1987 | Sarrazin | |
| 4,676,033 | A | * | 6/1987 | Allen et al. | 52/6 |
| 4,682,449 | A | * | 7/1987 | Berger | 52/66 |
| 4,683,686 | A | | 8/1987 | Ozdemir | |
| 4,706,420 | A | | 11/1987 | Winkler | |
| 4,716,691 | A | * | 1/1988 | Allen et al. | 52/6 |
| 4,738,057 | A | * | 4/1988 | Logan | 52/2.17 |
| 4,785,590 | A | | 11/1988 | Jones | |
| 4,807,312 | A | | 2/1989 | Baus | |
| 4,831,792 | A | * | 5/1989 | Berger | 52/66 |
| 4,884,376 | A | | 12/1989 | DeBlock et al. | |
| 4,922,666 | A | * | 5/1990 | Rotter et al. | 52/66 |
| 4,942,698 | A | * | 7/1990 | Kumagai | 52/6 |
| 4,977,713 | A | | 12/1990 | Zveibil | |
| 5,007,214 | A | * | 4/1991 | Itami et al. | 52/66 |
| 5,026,109 | A | * | 6/1991 | Merlot, Jr. | 296/105 |
| 5,035,093 | A | * | 7/1991 | Parazader et al. | 52/64 |
| 5,060,426 | A | * | 10/1991 | Jantzen | 52/86 |
| 5,063,730 | A | * | 11/1991 | Muramoto et al. | 56/66 |
| 5,101,605 | A | * | 4/1992 | Masuyama et al. | 52/66 |
| 5,156,195 | A | | 10/1992 | Wehler et al. | |
| 5,167,097 | A | * | 12/1992 | Robbie et al. | 52/6 |
| 5,167,341 | A | * | 12/1992 | Morton et al. | 220/349 |
| 5,203,125 | A | * | 4/1993 | Sugizaki | 52/66 |
| 5,257,481 | A | * | 11/1993 | Reppas et al. | 52/6 |
| 5,257,485 | A | * | 11/1993 | Kawaguchi et al. | 52/66 |
| 5,293,728 | A | | 3/1994 | Christopher et al. | |
| 5,297,368 | A | * | 3/1994 | Okada | 52/64 |
| 5,351,449 | A | * | 10/1994 | Allen et al. | 52/6 |
| 5,373,668 | A | * | 12/1994 | Shulman et al. | 52/66 |
| 5,394,659 | A | * | 3/1995 | Kawaguchi et al. | 52/66 |
| 5,394,660 | A | | 3/1995 | Haris | |
| 5,596,844 | A | | 1/1997 | Kallinowski | |
| 5,598,665 | A | | 2/1997 | Guddas | |
| 5,655,335 | A | * | 8/1997 | Vermeer | 52/66 |
| 5,778,603 | A | * | 7/1998 | Reppas | 52/66 |
| 5,791,094 | A | * | 8/1998 | Thomson | 52/64 |
| 5,797,224 | A | * | 8/1998 | Gunthardt | 52/79.4 |
| 5,907,928 | A | | 6/1999 | Charbonnel | |
| 5,983,575 | A | * | 11/1999 | Reppas | 52/66 |
| 6,003,279 | A | | 12/1999 | Schneider | |
| 6,065,252 | A | * | 5/2000 | Norsen | 52/66 |
| 6,082,054 | A | * | 7/2000 | Silberman et al. | 52/66 |
| 6,145,254 | A | * | 11/2000 | Silva | 52/66 |
| 6,155,005 | A | * | 12/2000 | McNamara | 52/169.6 |
| 6,332,645 | B1 | | 12/2001 | Schwarz | |
| 6,367,206 | B1 | * | 4/2002 | Silberman et al. | 52/66 |
| 6,430,879 | B1 | | 8/2002 | Nuiry et al. | |
| 6,474,027 | B2 | | 11/2002 | Nelson | |
| 6,591,557 | B1 | | 7/2003 | Thomsen et al. | |
| 6,604,327 | B1 | | 8/2003 | Reville | |
| 6,637,160 | B2 | | 10/2003 | Brooks | |
| 6,718,696 | B2 | * | 4/2004 | Silberman et al. | 52/6 |
| 6,851,227 | B1 | * | 2/2005 | Schildge, Jr. | 52/66 |
| 6,952,900 | B2 | * | 10/2005 | Leurent | 52/86 |
| 7,263,805 | B2 | | 9/2007 | Chapus | |
| 7,469,506 | B2 | | 12/2008 | Hosey | |
| 7,520,091 | B2 | * | 4/2009 | Friedman | 52/63 |
| 7,707,798 | B1 | * | 5/2010 | Cullinan | 52/780 |
| 7,748,429 | B2 | | 7/2010 | Caire et al. | |
| 7,752,815 | B2 | | 7/2010 | Lauria et al. | |
| 7,762,900 | B2 | | 7/2010 | Henry et al. | |
| 8,136,306 | B2 | * | 3/2012 | Scheps | 52/67 |
| 8,209,937 | B2 | * | 7/2012 | Scheps | 52/747.1 |
| 8,215,066 | B2 | * | 7/2012 | Hosking et al. | 52/66 |
| 8,251,832 | B2 | * | 8/2012 | Henry et al. | 472/117 |
| 8,322,084 | B2 | * | 12/2012 | Kestermann | 52/79.1 |
| 8,336,261 | B2 | * | 12/2012 | Hosking et al. | 52/66 |
| 8,381,452 | B1 | * | 2/2013 | Forsland et al. | 52/66 |
| 8,387,315 | B2 | * | 3/2013 | Hosking et al. | 52/66 |
| 8,397,440 | B1 | * | 3/2013 | Ceballos | 52/66 |
| 8,413,705 | B2 | * | 4/2013 | Castel | 160/107 |
| 8,505,246 | B1 | * | 8/2013 | Cadorath | 52/79.6 |
| 8,511,001 | B2 | * | 8/2013 | Uffner et al. | 52/66 |
| 8,555,557 | B2 | * | 10/2013 | Hosking et al. | 52/66 |
| 8,590,214 | B2 | * | 11/2013 | Laprise et al. | 52/66 |
| 2002/0032993 | A1 | | 3/2002 | Nelson | |
| 2002/0129565 | A1 | * | 9/2002 | Silberman et al. | 52/66 |
| 2002/0134028 | A1 | * | 9/2002 | Silberman et al. | 52/6 |
| 2003/0000154 | A1 | | 1/2003 | Ignazio | |
| 2003/0014927 | A1 | | 1/2003 | Brooks | |
| 2003/0046879 | A1 | * | 3/2003 | Jahanpour | 52/66 |
| 2004/0187397 | A1 | | 9/2004 | Chapus | |
| 2005/0235579 | A1 | * | 10/2005 | Hosey | 52/68 |
| 2006/0032156 | A1 | * | 2/2006 | Simard | 52/66 |
| 2006/0248807 | A1 | * | 11/2006 | Penna | 52/64 |
| 2007/0017163 | A1 | * | 1/2007 | Silberman et al. | 52/41 |
| 2007/0051054 | A1 | * | 3/2007 | Devincenzo et al. | 52/72 |
| 2007/0294958 | A1 | * | 12/2007 | Kestermann | 52/79.1 |
| 2009/0107061 | A1 | | 4/2009 | Guthrie | |
| 2009/0158673 | A1 | * | 6/2009 | Friedman | 52/66 |
| 2009/0300997 | A1 | | 12/2009 | Scheps | |
| 2010/0105282 | A1 | * | 4/2010 | Alazemi | 449/26 |
| 2011/0036021 | A1 | * | 2/2011 | Lonnberg | 52/64 |
| 2011/0162808 | A1 | * | 7/2011 | Castel | 160/174 R |
| 2011/0308173 | A1 | | 12/2011 | Forsland et al. | |
| 2012/0000141 | A1 | * | 1/2012 | Forsland et al. | 52/66 |
| 2012/0031013 | A1 | * | 2/2012 | Scheps | 52/67 |
| 2012/0090250 | A1 | * | 4/2012 | Moscovitch | 52/68 |
| 2012/0131858 | A1 | * | 5/2012 | Hosking et al. | 52/6 |
| 2012/0131859 | A1 | * | 5/2012 | Hosking et al. | 52/6 |
| 2012/0131860 | A1 | * | 5/2012 | Hosking et al. | 52/8 |
| 2012/0131861 | A1 | * | 5/2012 | Hosking et al. | 52/8 |
| 2012/0291363 | A1 | * | 11/2012 | Forsland et al. | 52/67 |
| 2013/0305625 | A1 | * | 11/2013 | Pike et al. | 52/64 |
| 2013/0305627 | A1 | * | 11/2013 | Pike et al. | 52/79.5 |

FOREIGN PATENT DOCUMENTS

| | | | | |
|---|---|---|---|---|
| FR | 2 623 550 | A1 | | 5/1989 |
| FR | 2 866 379 | A1 | | 8/2005 |
| FR | 2876399 | A1 | * | 4/2006 |
| GB | 2 097 849 | A | | 11/1982 |

(56) References Cited

FOREIGN PATENT DOCUMENTS

| | | | | |
|---|---|---|---|---|
| GB | 2 135 372 | A | | 8/1984 |
| GB | 2400387 | A | * | 10/2004 |
| GB | 2 414 251 | A | | 11/2005 |
| JP | 4-203061 | | | 7/1992 |
| JP | 5-231071 | | | 9/1993 |
| JP | 2003-293457 | | | 10/2003 |
| JP | 2005083117 | A | * | 3/2005 |
| NL | 9500387 | | | 10/1996 |
| WO | WO 2011088113 | A1 | * | 7/2011 |
| WO | WO 2013090429 | A1 | * | 6/2013 |

OTHER PUBLICATIONS

U.S. Appl. No. 13/043,162, filed Mar. 8, 2011 entitled "Flexible Space Technologies".
Brochure from Libart Enclosure Systems, 12 pages (Publicly known at least as early as Jan. 2009).
Brochure from Roll-A-Cover, International, 8 pages (Publicly known at least as early as Jan. 2009).
Images from www.libart.com website, 18 pages (Date Printed Jan. 25, 2011).
International Search Report and Written Opinion mailed Mar. 14, 2011 for Int'l App. No. PCT/US2011/020977.

* cited by examiner

STRUCTURE HAVING CONVERTIBLE ROOF AND WALLS

CROSS-REFERENCE TO RELATED APPLICATIONS

The present application is a continuation of U.S. patent application Ser. No. 13/041,237, filed on Mar. 4, 2011, which is a continuation-in-part of PCT Patent Application No. PCT/US11/20977, filed on Jan. 12, 2011, which claims priority to U.S. Provisional Patent Application Ser. No. 61/294,302, filed on Jan. 12, 2010, which applications are hereby incorporated by reference in their entireties.

BACKGROUND OF THE INVENTION

The present invention relates in general to the field of enclosures. More particularly, the present invention relates to enclosures that are selectively collapsible and/or movable. Specifically, a preferred embodiment of the present invention relates to an enclosure configured to enclose an outdoor location wherein the enclosure is selectively collapsible for storage. The present application incorporates by reference U.S. Provisional Patent Application Ser. No. 61/240,020 filed Sep. 4, 2009 and entitled "Movable Enclosure" and Non-Provisional patent application Ser. No. 12/875,833 filed Sep. 3, 2010 and entitled "Movable Enclosure."

Enclosures for use outdoors are generally known in the art. Such enclosures are typically constructed to cover a predetermined area to protect the predetermined area from exposure to the elements. These enclosures suffer from a number of disadvantages. For instance, such enclosures are typically constructed so as to permanently cover the predetermined area. This may be undesirable where coverage for the predetermined area is only necessary or desired for a given period of time and where exposure to the elements may be desired on occasion. Further, such enclosures are generally not selectively configurable and are permanent in nature.

Some other such enclosures are configured for temporary use whereby they may be constructed to cover the predetermined area and taken down after use thereof. However, such enclosures are typically generally not capable of withstanding a wide variety of weather conditions such as wind, rain, and snow.

An enclosure that overcomes one or more the foregoing disadvantages is therefore desired.

SUMMARY AND OBJECTS OF THE INVENTION

By way of summary, the present invention is directed to an enclosure that is configured for outdoor use. The enclosure according to the present invention preferably comprises an enclosure having a number of sides and a roof assembly extending upwardly from the sides. The sides of the enclosure are preferably supported on a number of rails attached to the ground. The sides of the enclosure are secured to the rails preferably by rollers or similar such members such that the sides are selectively movable along the rails. Each of the sides of the enclosure comprises a number of panels. The panels of the enclosure are configured to cooperate with the other panels of a particular side of the enclosure such that the panels may be selectively retracted so as to overlap one another and thereby collapse the enclosure for storage. Similarly, the roof of the enclosure comprises a number of roof panels that cooperate with one another such that they overlap one another when retracted. When the enclosure is in the closed position and the side panels and roof panels are retracted and overlap one another, a user may selectively extend the enclosure to a number of intermediate positions whereby the respective panels are extended to form an enclosure.

Another aspect of the present disclosure relates to an enclosure that is convertible between an enclosed configuration and an open configuration. When in the enclosed configuration, the enclosure can have the appearance, character and feeling of a permanent building. When in the open configuration, the enclosure has the feeling of an open air space. In certain embodiments, the enclosure can include movable roof sections and movable wall sections. To promote flexibility, the roof sections and the wall sections can be independently movable relative to each other. In certain embodiments, enclosures in accordance with the principles of the present disclosure can be used to provide custom convertible structures such as convertible patios. For certain applications (e.g., restaurants, bars, hotels, etc.), such convertible patios can be integrated with an existing permanent building and used to provide extra enclosed seating space (e.g., heated and covered space) during inclement weather or during the winter, and can also be used to provide open air seating when weather permits.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
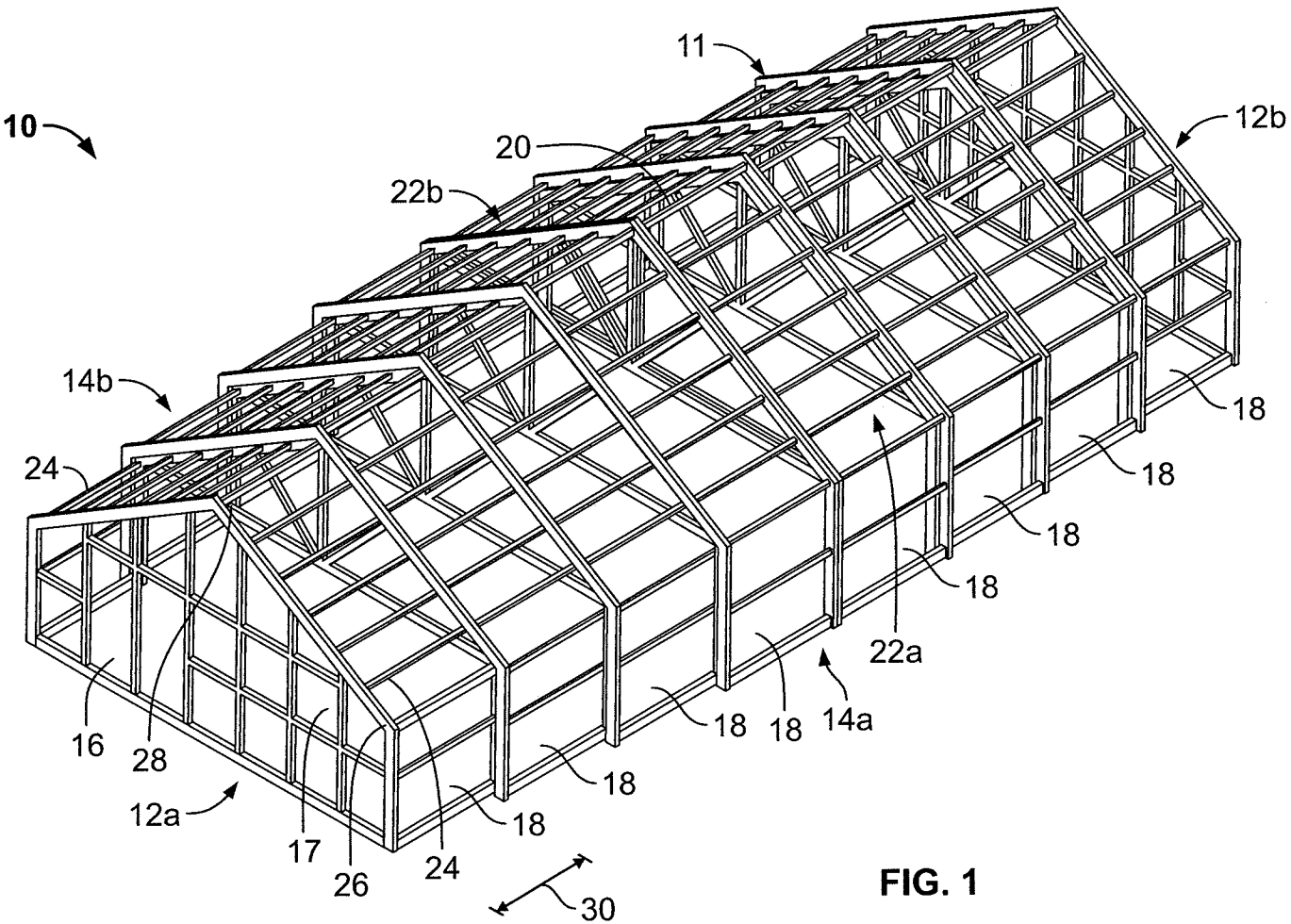
FIG. 1 is a perspective view of a first embodiment of a enclosure according to the present invention shown in a closed configuration.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF PREFERRED EMBODIMENTS

Referring now to the drawings, and initially to FIGS. 1-10, a representative embodiment of an enclosure 10 according to the present invention is illustrated. The enclosure 10 is configured to selectively enclose a particular area such that the area enclosed may be protected from the environment, i.e., hot or cold weather, rain, snow, etc. Alternatively, the enclosure 10 may be arranged such that the area enclosed is completely or partially exposed to the elements as desired.

Referring initially to FIGS. 1-5, the enclosure 10 is defined by a frame 11 and preferably includes two ends 12*a*, 12*b* and a pair of sides 14*a*, 14*b* extending between ends 12*a* and 12*b*. Ends 12*a*, 12*b* are fixed in place and define a length of a standalone enclosure 10. In an alternative embodiment enclosure 10 may be interconnected with or otherwise associated with another enclosure, and thus, one of ends 12*a*, 12*b* may be fixed to a wall or ends 12*a*, 12*b* may be fixed to or otherwise integrally formed with a pair of walls (not shown) to define a longitudinal length of enclosure 10. The walls may be constructed from any suitable material including brick, concrete, wood, and the like. Ends 12*a*, 12*b* may include one or more doors 16 and/or windows 17. Alternatively, sides 14*a*, 14*b* may include one or more doors 16 and/or windows 17 either instead of or in addition to providing doors 16 and/or windows 17 at ends 12*a*, 12*b*. Sides 14*a*, 14*b* may include a number of independent side panels 18 that are defined by interconnected horizontal and vertical members of frame 11. Side panels 18 may comprise a rectangular cross-section and lower ends of side panels 18 are fixed to a track or rail for axial travel therealong. Enclosure 10 includes a roof 20 comprised of a number of roof panels 24. Roof 20 may be pitched to prevent water, snow, debris, etc. from settling on the roof. Also, the pitched roof 20 prevents the retention of debris on the roof 20 that may be capable of interfering with the operation of the enclosure 10 as will be explained in detail herein. Alternative constructions are contemplated where only one side of roof 20 is pitched or the like. Of course, roof 20 may alternatively be flat or have any other such construction. Roof 20 is preferably constructed from a relatively lightweight material to facilitate movement thereof. In the present embodiment, each of the side panels 18 are integrally formed with a roof panel 24 to form a segment 30 capable of unitary and simultaneous movement independent from the other segments 30 of the enclosure 10.

Frame 11 is configured for supporting the enclosure 10. Frame 11 may be constructed from an aluminum extrusion or similar such material capable of providing a relatively sturdy structure while remaining relatively lightweight such that the frame 11 of enclosure 10 may be moved according to the present invention as will be explained further herein. Frame 11 comprises a plurality of interconnected members configured to define the area of enclosure. The members of frame 11 may include a finish thereover to provide an aesthetically pleasing appearance. For instance, the members of frame 11 may be coated with a finish such as, for example, Kynara Also, the aluminum may be anodized.

The members are sized and spaced to define the individual side panels 18 to form sides 14*a*, 14*b* and roof panels 24 to form roof 20. Side panels 18 and roof panels 24 may include a see-through material disposed between the members of frame 11 for providing a generally transparent enclosure that is aesthetically pleasing and protected from the elements. For instance, the side panels 18 and roof panels 24 may be constructed from a material such as, for example polycarbonate, glass, or a similar such material having similar characteristics with regards to transparency, durability, strength, etc. The side panels 18 and roof panels 24 may be opaque, tinted, clear, or a combination thereof. In one embodiment of the present invention, the side panels 18 are constructed from ⅛ inch polycarbonate while roof panels 24 are constructed from two wall polycarbonate, i.e., ¼ inch. In a preferred embodiment, the side panels 18 and roof panels 24 are constructed from an insulated material such as insulated glass or insulated polycarbonate. Understandably, side panels 18 and roof panels 24 may be opaque or only partially transparent or translucent. It will be appreciated that all of the enclosure embodiments disclosed herein can have roof and wall panels can be light transmissive (capable passing light there-through such as transparent or frosted) or could also be opaque (not capable of passing light therethrough).

Further, enclosure 10 of the current invention is preferably configured to handle loads of relatively heavy materials such as snow and ice. In one embodiment segments 30 are configured to withstand loads of snow of up to 60 pounds per square foot and wind speeds of up to 90 miles per hour. In addition, segments 30 may include one or more stiffeners (not shown) that may be selectively coupled to the roof for reinforcement thereof.

The members of frame 11 preferably include sealing means at points of interconnection therebetween. Further, such sealing means is preferably provided for between the individual segments 30. The sealing means may comprise any number of different types of seals capable of maintaining a water-tight coupling between the segments 30 as is generally understood in the art. Likewise, frame 11 and enclosure 10 in its entirety may include sealing means, similar to that used at points of member interconnection and between segments 30, along the floor of enclosure 10 to prevent water or other environmental contaminants from entering the enclosure 10 from the surrounding ground. The floor of enclosure 10 may be a cement pad that is pre-installed at the area to be enclosed. Alternatively, the floor of enclosure 10 may be brick, wood decking, an unfinished ground surface such as grass or dirt, or the like. The floor of enclosure 10 may further include Sonotubes or similar such forming tubes for providing a strong foundation for supporting the enclosure 10. Similar floors and foundations can be used for each of the embodiments disclosed herein. The members of frame 11 may be covered with wood, plastic or aluminum trim (not shown) to improve the aesthetic appearance of enclosure 10. The trim may be configured to simply snap on over the members of frame 11.

Enclosure 10 is formed from a number of segments 30 configured to cooperate with one another to form an enclosure for protecting a selected area from the external environment. As illustrated, enclosure 10 comprises eight segments 30*a*-30*h*, although it is understood that any number of segments may be utilized in practicing the present invention. End segments 30*a* and 30*h* are configured to be stationary whereas the other segments 30*b*-30*g* are movable as will be explained herein. Each of segments 30*a*-30*d* is arranged in a stepwise manner wherein the preceding segment with respect to end 12*a* comprises a smaller width and shorter height.

Similarly, segments 30*e*-30*h* are arranged such that each preceding segment with respect to end 12*b* comprises a smaller width and a shorter height than the adjacent segment. Accordingly, when it is desired to open the enclosure 10, the segments 30 are capable of being moved toward its respective end 12*a* or 12*b* to overlap the adjacent segment. Of course, it is understood that alternative arrangements are within the scope of the present invention. For instance, the centrally located segments may be smaller than the adjacent, laterally positioned segments. Any number of alternative arrangements is within the scope of the present invention, and the foregoing descriptions are merely exemplary.

Figure 2:
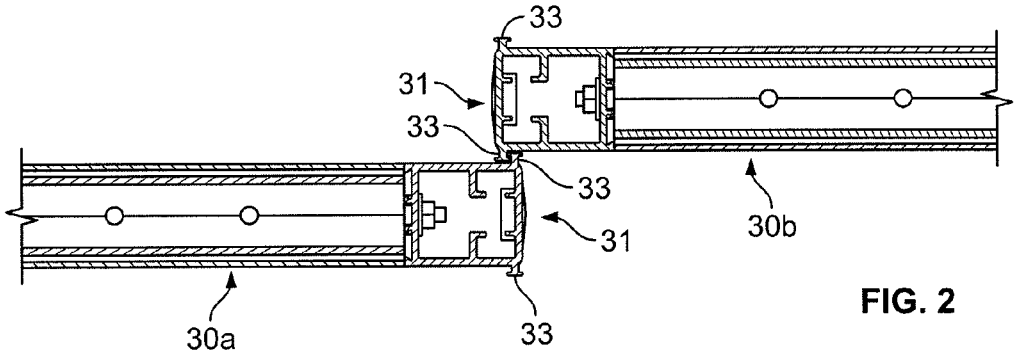
FIG. 2 is a top view of a pair of adjacent segments of the enclosure of FIG. 1 showing a coupling arrangement between the adjacent segments.
Figure 3:
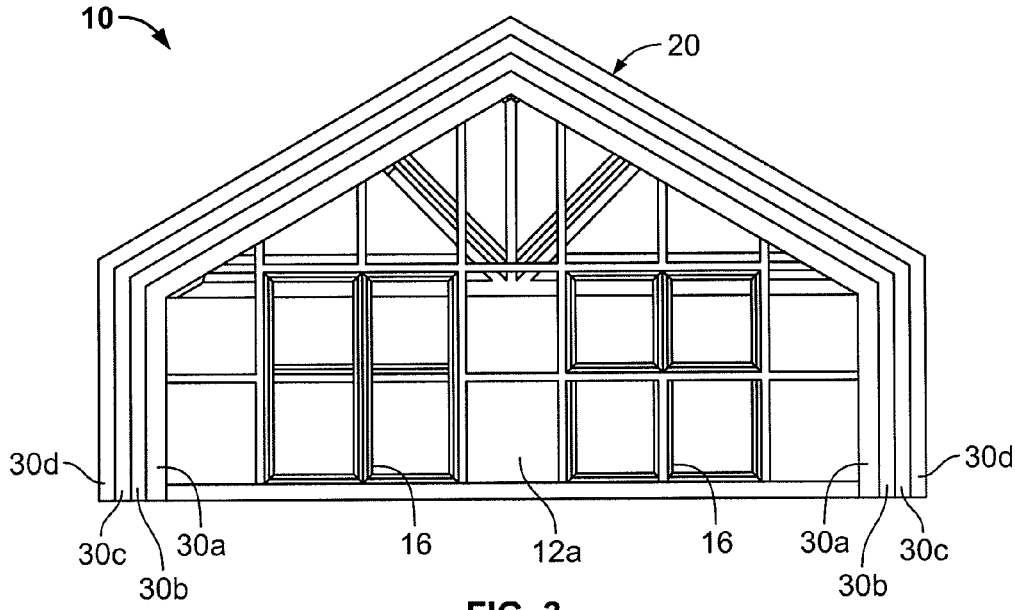
FIG. 3 is an end elevation view of the enclosure of FIG. 1.
Figure 4:
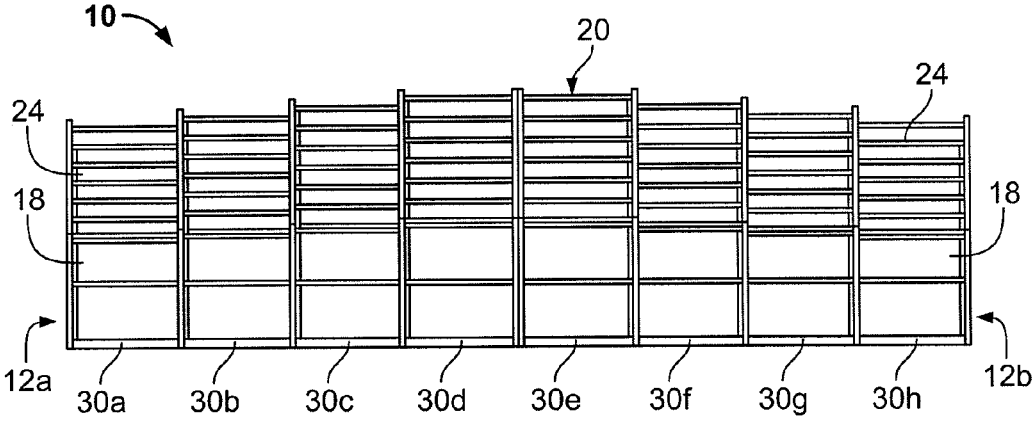
FIG. 4 is a side elevation view of the enclosure of FIG. 1.
Figure 5:
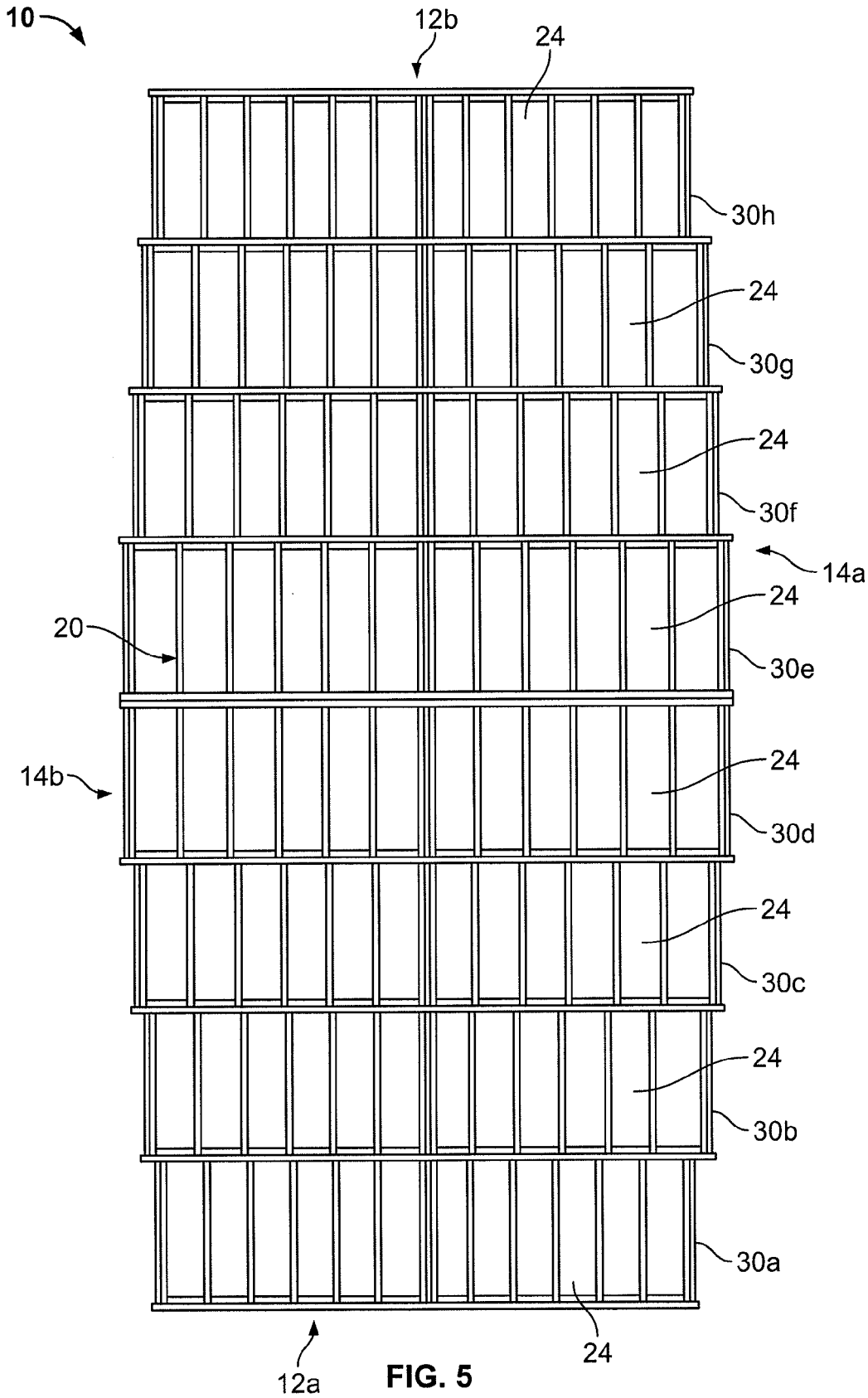
FIG. 5 is a top plan view of the enclosure of FIG. 1.

Referring now to FIG. 2, a schematic illustration of the interconnection of two adjacent segments 30 is shown. In particular, a first segment 30*a* is coupled to a second segment 30*b* in a partially overlapping manner. Segments 30*a* and 30*b* include coupling assemblies 31 at adjacent ends thereof. Coupling assemblies 31 may be provided along the interlocking surfaces of each of the segments 30. In particular, coupling assemblies 31 may extend along an entire vertical length of the interlocking surfaces of the segments 30 or a portion thereof. Coupling assemblies 31 include a pair of selectively interlocking elements 33 provided on opposing ends thereof Each of the interlocking elements 33 is configured to engage the interlocking element 33 of an adjacent segment 30 when the segments 30 are moved to their closed positions. For instance, as shown in FIG. 2, segment 30*a* includes an interlocking element 33 positioned adjacent a corresponding interlocking element 33 of segment 30*b* such that the two interlocking elements may engage one another to thereby secure the segments 30*a* and 30*b* to one another.

Understandably, the other of the interlocking elements 33 as shown in FIG. 2 may be selectively coupled with another, adjacent segment 30 in a partially overlapping manner.

Thus, as the segments are moved along the tracks 21 from the open position to the closed position, each of the adjacent segments is moved toward a longitudinal center of the enclosure 10. As each of the segments progresses along the tracks 21, they will engage the interlocking element of the adjacent segment. The coupling assemblies 31, in combination with the tracks 21 guide the segments 30 such that all retract in a single given direction. Moreover, coupling assemblies 31 prevent adjacent segments 30 from sliding past one another to avoid leaving a gap in the otherwise continuous wall surface of the enclosure 10. In addition, coupling assemblies 31 prevent adjacent segments 30 from swinging or moving apart from one another in a direction perpendicular to their retraction.

Each segment 30 according to the present embodiment comprises a pair of opposed side panels 18 forming a portion of side walls 14, 14*b* respectively. The opposing side panels 18 are interconnected to one another by way of a pair of integral roof panels 24, one on each side of enclosure 10. Accordingly, side panels 18 and roof panels 24 cooperate to form an enclosure constructed from a number of individual segments that extend vertically from a ground surface to form an overhanging enclosure 10. Roof 20 may be constructed so as to have an off-set peak or such that the roof is equally pitched on either side thereof. Similarly, one of sides 14*a* or 14*b* may extend higher than the other of the sides 14*a* or 14*b*.

Each roof panel 24 of segments 30 are attached to its respective side panel 18 at a first end 26 of the respective roof panel 24. Each roof panel 24 includes a second end 28 that is integrally formed with a corresponding second end of an adjacent roof panel 24. The adjacent roof panel 24 likewise includes a first end 26 coupled to an upper portion of a side panel 18 to form a unitary segment 30 of enclosure 10. The side panels 18 and roof panels 24 may be selectively and individually openable by any number of known mechanisms.

Side panels 18 are secured at a lower end thereof to a track (not shown) attached directly to the ground or the floor of the enclosure. The track may comprise any type of rail as is generally understood in the art. The lower ends of side panels 18 are configured to cooperate with the track to ride therealong as will be described in detail herein. For example, the lower ends of side panels 18 may comprise a plurality of rollers (not shown) adapted to cooperate with the track to move therealong. The lower ends of side panels 18 may comprise any known method of cooperating with and riding along tracks for movement thereon. Preferably, the tracks are configured such that the side panels 18 and roof panels 24 may be simultaneously moved toward one or both of the ends 12*a*, 12*b* in an overlapping fashion such that enclosure 10 is collapsible or may otherwise be configured for storage thereof. Side panels 18 and roof panels 24 may slide either under or over the fixed end.

Figure 6:
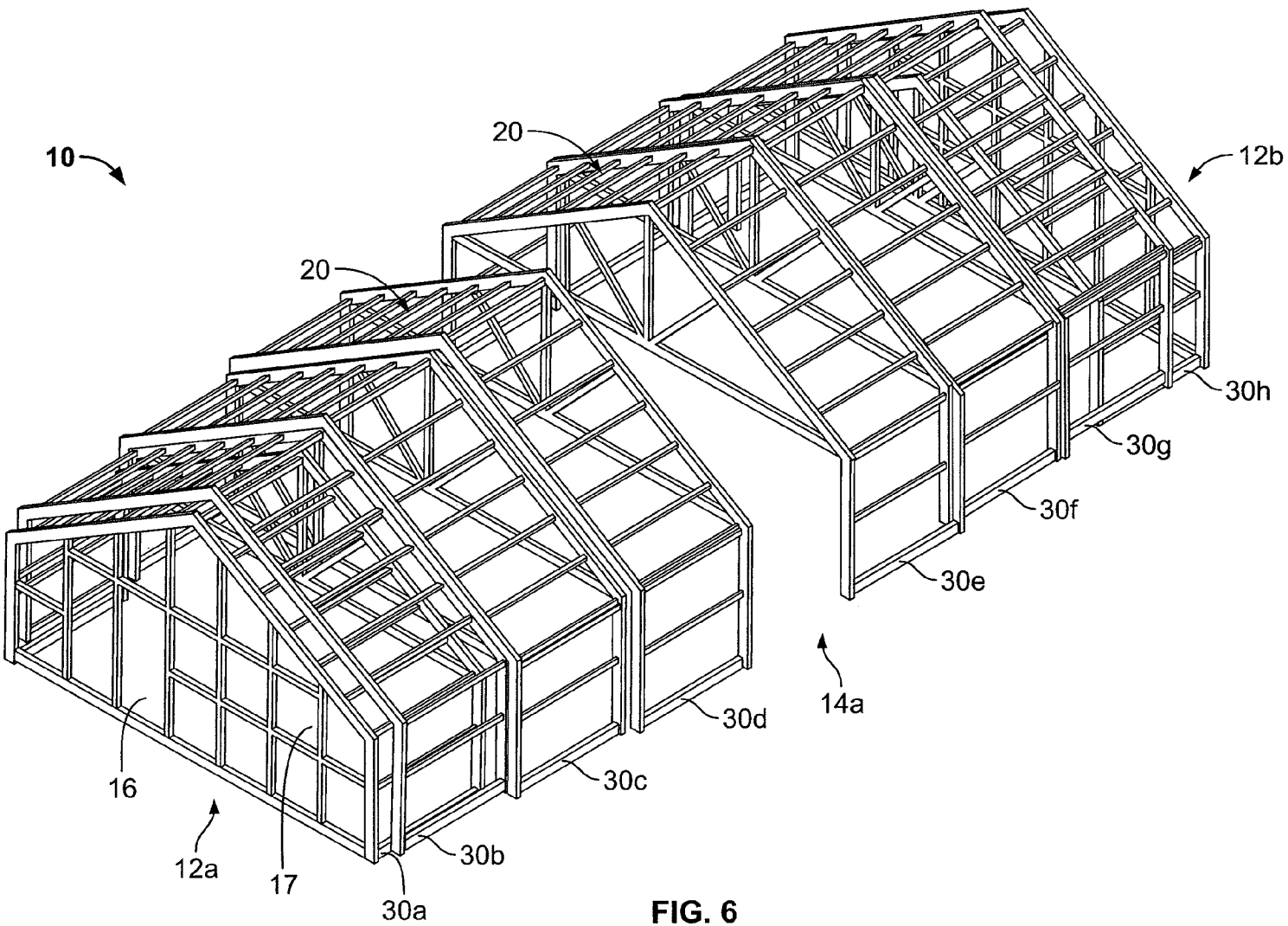
FIG. 6 is a perspective view of the enclosure of FIG. 1 in which the enclosure is in an intermediate position
Figure 7:
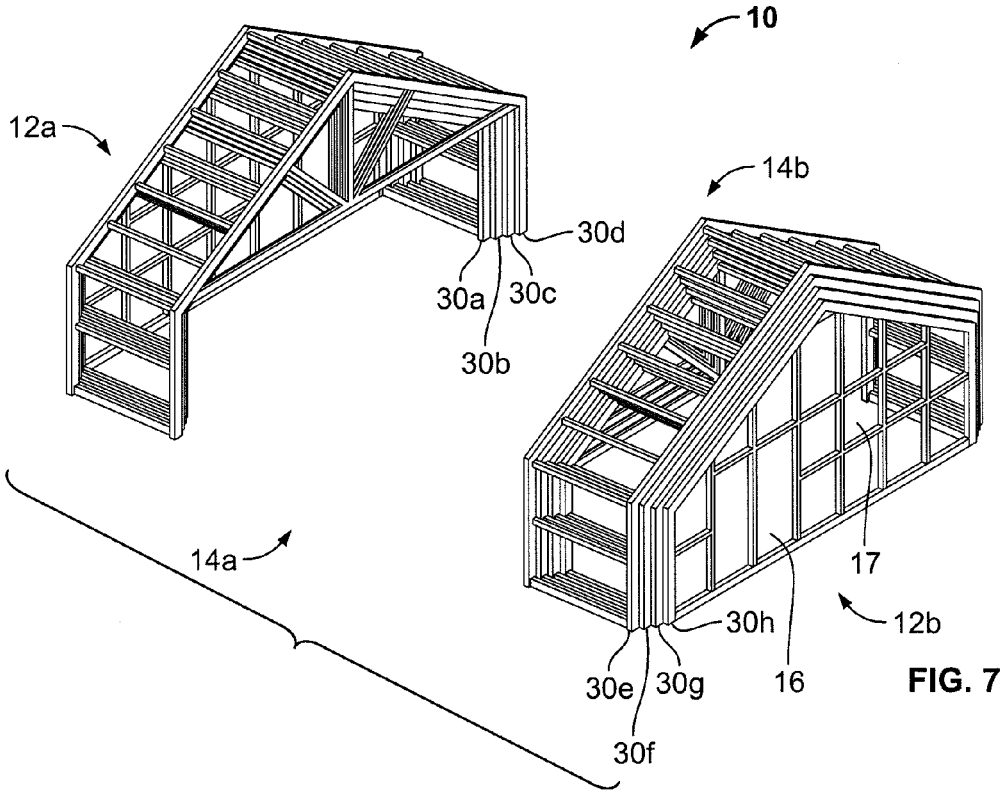
FIG. 7 is a perspective view of the enclosure of FIG. 1 shown in an open configuration.
Figure 8:
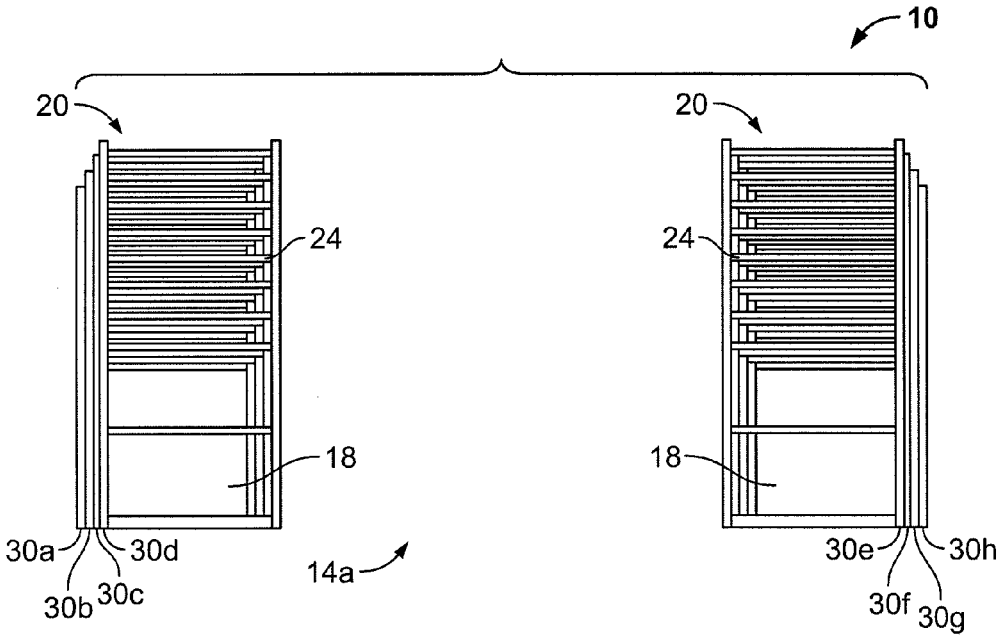
FIG. 8 is a side elevation view of the enclosure as shown in FIG. 7.

Referring now to FIGS. 6-8, in operation, a user may selectively retract segments 30 of enclosure 10 as illustrated. Segments 30 may be coupled to a power source (not shown) or may otherwise be manually movable along the tracks. As desired, the user of enclosure 10 may slide one of segments 30 toward either of ends 12*a*, 12*b* such that each segment 30 overlaps the subsequent segments such that enclosure 10 may be configured in an open position wherein the area enclosed by enclosure 10 is freely accessible for ingress and egress and exposed to the elements. Alternatively, a user may extend each of segments 30 so as to form a completed enclosure similar to that seen in FIGS. 1-4. Referring momentarily to FIG. 6, enclosure 10 is shown in an intermediate position, i.e., between the closed position shown in FIGS. 1-4 and the open position shown in FIGS. 7-8. As shown, segment 30*b* is fully retracted such that it overlaps segment 30*a*. Segments 30*c* and 30*d* are partially retracted toward end segment 30*a*. As enclosure 10 is moved from its closed configuration to its open configuration, segments 30*c* and 30*d* will continue to travel along the track to overlap segments 30*a* and 30*b* to arrive at the open configuration illustrated in FIGS. 6 and 7 as can be readily appreciated. The other half of enclosure 10, i.e., segments 30*e*-30*h* operates in a likewise manner.

Numerous configurations of the enclosure 10 are contemplated. That is, only part of enclosure 10 may be in the fully closed position whereas the remaining part of the enclosure 10 may be in a fully open position. Alternatively, the enclosure 10 may be configured such that one or both ends of the enclosure 10 are only partially retracted. Enclosure 10 may be configured such that it is retracted into, or in coordination with, another structure such as a garage or pool house, or alternatively, enclosure 10 may comprise a stand-alone structure offset from any other structures. Enclosure 10 may be configured to include a number of independent controls such that each control is assigned to one half of the structure such that only one half of enclosure 10 is opened or closed.

Figure 9:
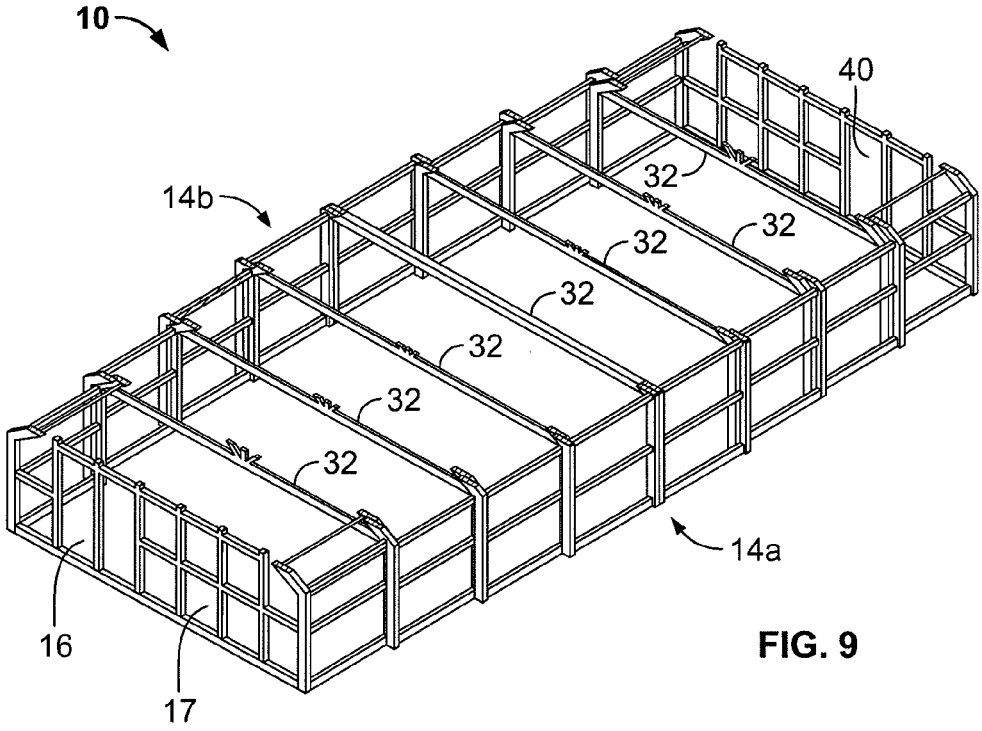
FIG. 9 is a perspective cross-sectional view of the enclosure of FIG. 1.
Figure 10:
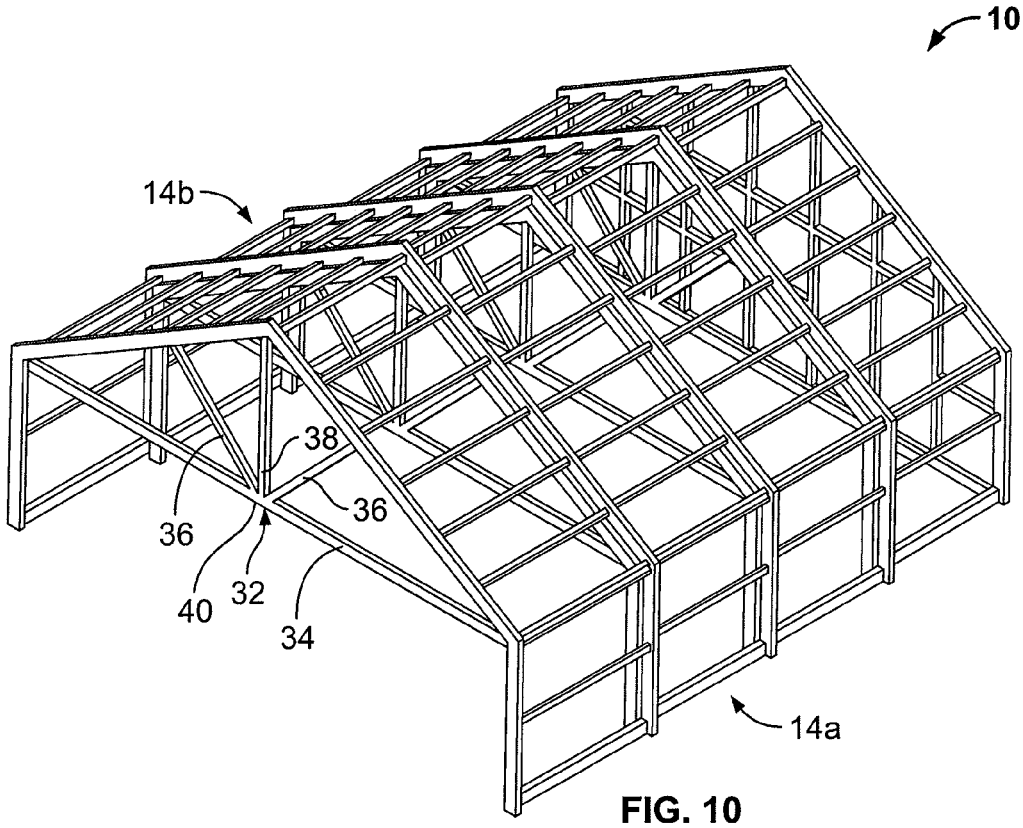
FIG. 10 is a partial perspective view of the enclosure of FIG. 1.

Now referring to FIGS. 9 and 10, frame 11 of enclosure 10 is illustrated in part. Each roof panel 24 is supported by a truss 32. Truss 32 includes a single horizontal member 34 extending across the width of each segment 30 and coupled between sides 14*a*, 14*b*. A pair of angled supports 36 is coupled between roof 20 and the horizontal member 34. In particular, one of the angled supports 36 extends from roof member 22*a* and the other from roof member 22*b*. A vertically extending post 38 bisects the angled supports 38 and extends from a peak of roof 20 to horizontal member 34. Angled supports 36 and vertically extending post 38 meet at a common location along the length of the horizontal member 32 to define a joint 40. A number of alternative constructions may be utilized in supporting roof 20 and roof panels 24 as is generally understood in the art.

Figure 25:
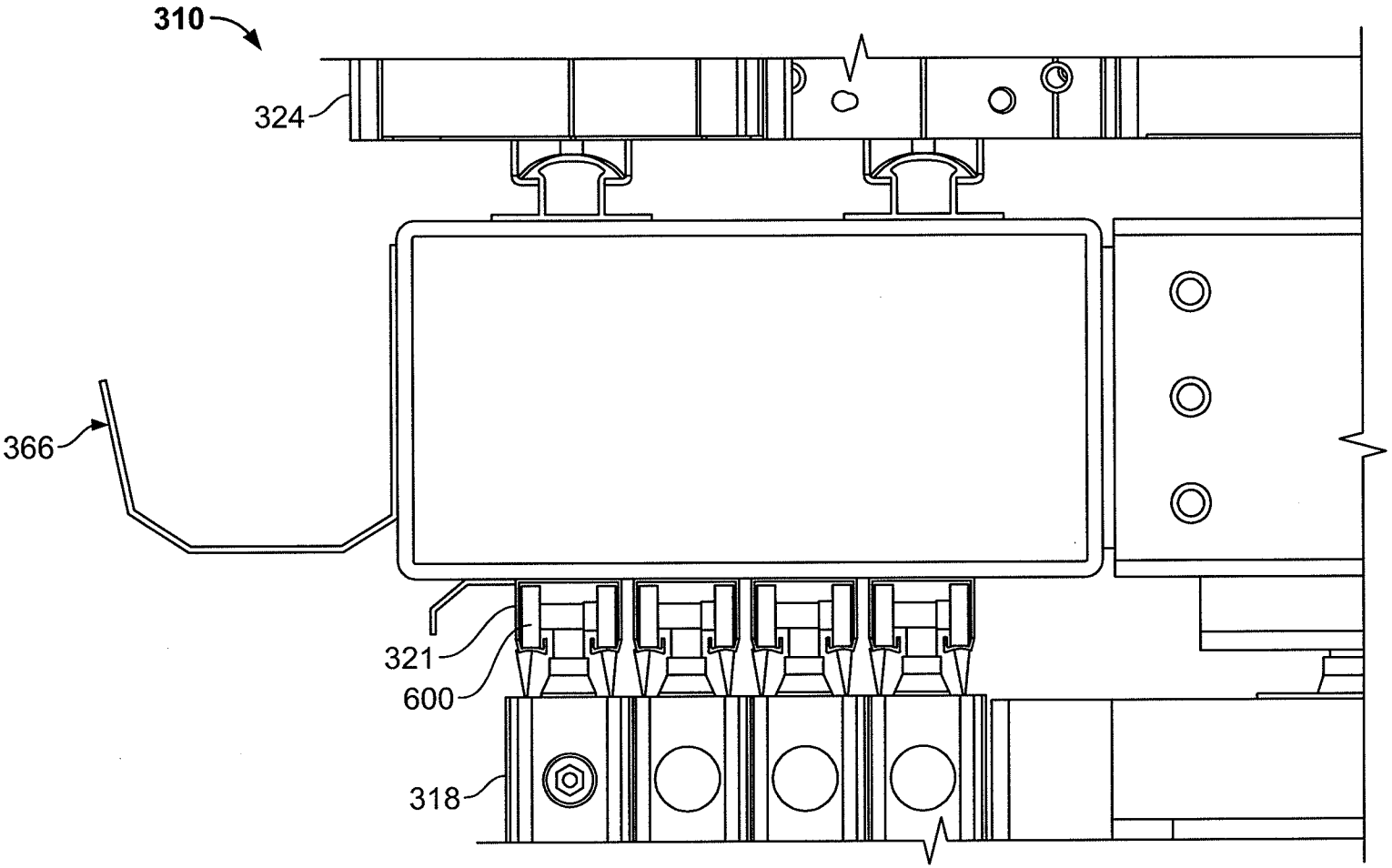
FIG. 25 is a side elevation view of an enclosure according to another construction of the present invention showing a water management system.

Referring now to FIGS. 11-15, a second embodiment of the enclosure 110 of the present invention is illustrated. Like the previous embodiment, enclosure 110 includes a frame 111 for supporting the structure thereof. The enclosure 110 of the second embodiment includes a pair of opposing ends 112 interconnected with one another by way of a pair of opposing sides 114 supported by frame 111. Ends 112 include convertible end walls defined by a plurality of movable end wall panels 116 (i.e., door or wall sections) that can be used for ingress and egress between the interior of enclosure 10 and the surrounding area. Sides 114 include convertible side walls defined by side wall panels 118 (i.e., doors, wall sections or wall panels). Side wall panels 118 are movably coupled to a side wall track assembly 119. Side wall track assembly 119 includes an upper track 119*a* and a lower track 119*b* that extend along a length of the enclosure 110. Side wall panels 118 are secured between the upper track 119*a* and the lower track 119*b* to move therealong as is generally understood. Similar track assemblies can be provided for the wall panels 116 of the end walls. Alternatively, the wall panels 116, 118 can be hung from elevated tracks 321 as shown at FIG. 25.

The frame 111 defines a fixed rectangular boundary or perimeter corresponding to the enclosable space of the enclosure 110 (i.e., the space defined inside the ends 112 and sides 114 of the enclosure). The frame 111 includes a plurality of fixed vertical posts that can be supported on footings such as Sonotubes, a floating cement slab, frost wall footings, an existing deck or patio or other suitable foundation. The vertical posts include corner posts 500 positioned at the corners of the enclosable space, and intermediate posts 502 positioned at the sides and ends of the enclosure adjacent midpoints between the corner posts. The frame 111 also includes horizontal beams supported on top of the vertical posts at roof level. The horizontal beams are preferably supported at a height above head level (e.g., at a height of at least 7 feet and preferably about 8 or 9 feet). The horizontal beams include side beams 504 that extend along the sides 114 of the enclosure and end beams 506 that extend along the ends 112 of the enclosure. The side beams 504 include end portions 508 that extend outwardly beyond the end walls and corner posts 500 of the enclosure 110. The end portions 508 are supported by further posts (e.g., supports 123) located outside the perimeter of the enclosable space of the enclosure.

Figure 12:
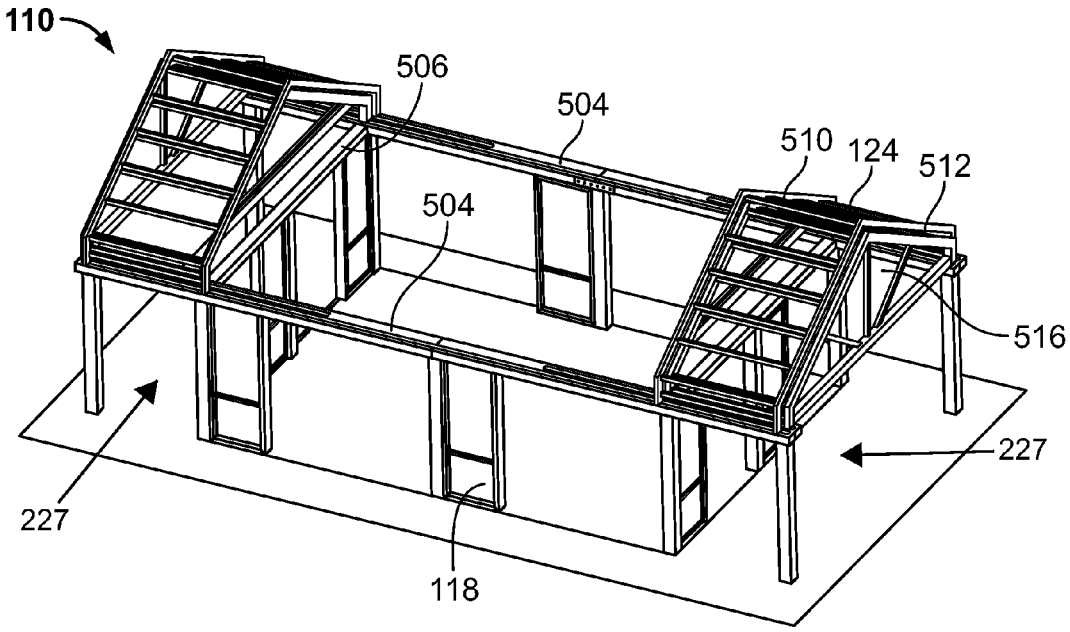
FIG. 12 is a perspective view of the enclosure of FIG. 11 in an open configuration.
Figure 13:
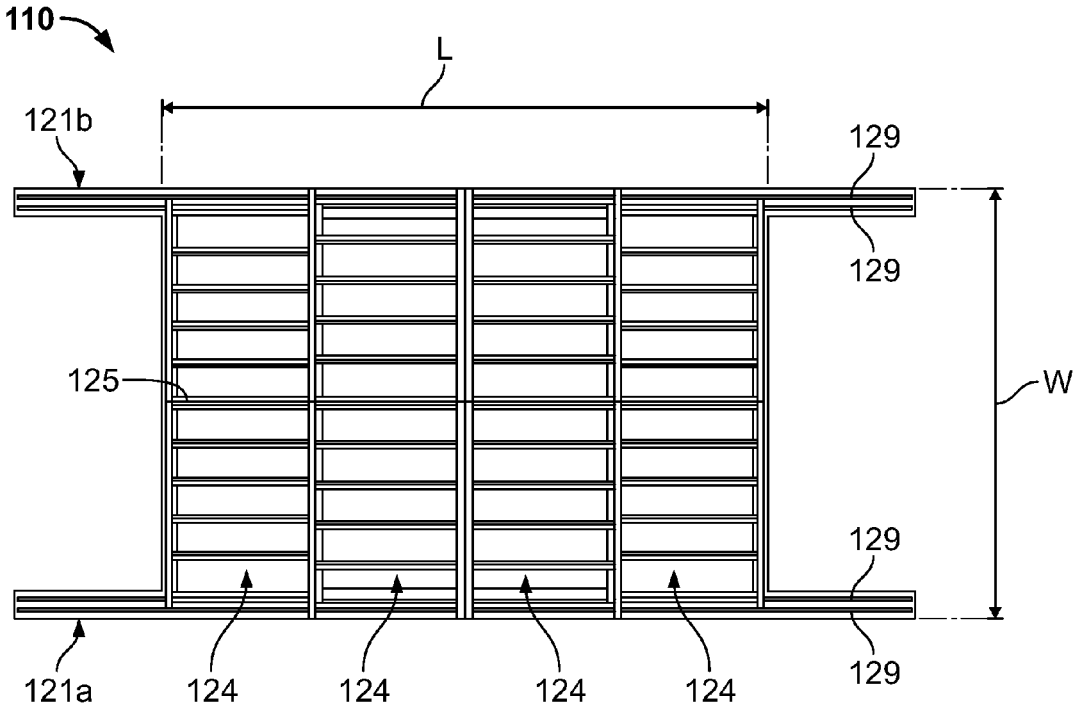
FIG. 13 is a top plan view of the enclosure of FIG. 11.
Figure 14:
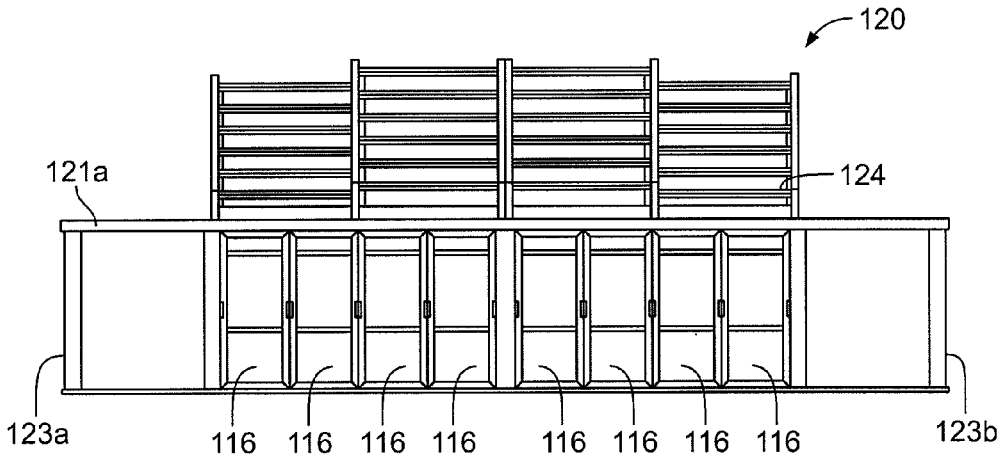
FIG. 14 is a side elevation view of the enclosure of FIG. 11 with the opposite side being identical thereto.
Figure 15:
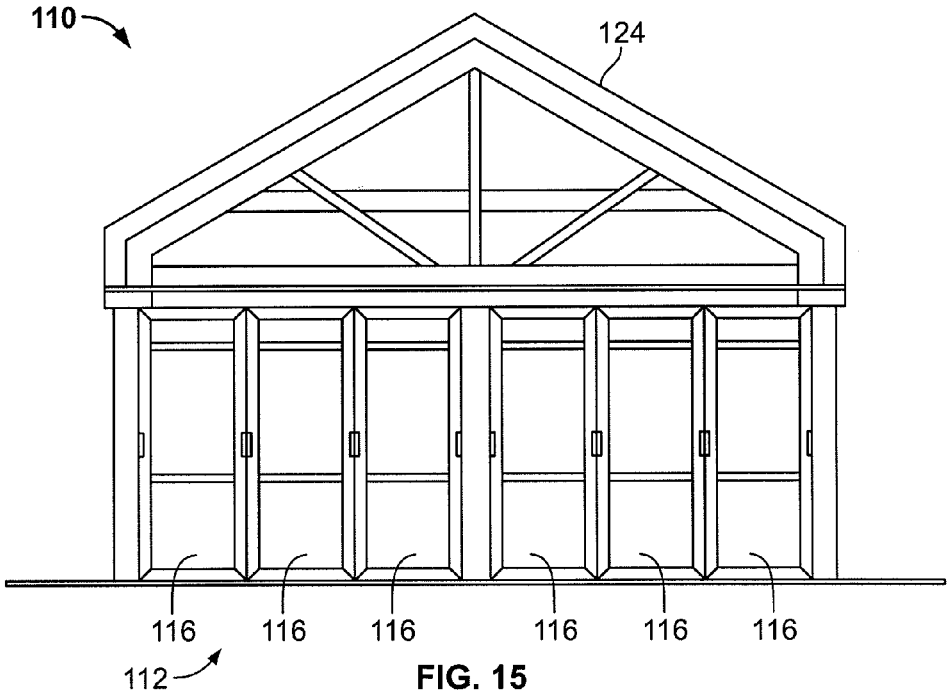
FIG. 15 is an end elevation view of the enclosure of FIG. 11.

Enclosure 110 further includes a roof 120 comprising a plurality of independently movable roof panels 124. Roof panels 124 comprise unitary structures configured to span the width of enclosure 110, and each roof panel 124 comprises a pair of sides, 140*a* and 140*b*, respectively, that are pitched so as to meet at a medial position along the width of the enclosure 110 to define a peak 125. The roof panels 124 are positioned immediately laterally adjacent to one another so as to cooperate with one another to form a pitched roof 120. A lower portion of each of roof panels 124 is movably coupled to an upper track assembly 121. Upper track assembly 121 comprises a pair of laterally spaced tracks 121*a* and 121*b*, respectively in which each of the laterally spaced tracks 121*a* and 121*b* are supported by a pair of longitudinally spaced supports 123*a* and 123*b* and 123*c* and 123*d* (collectively supports 123), respectively. Specifically, the tracks are mounted on top of the horizontal side beams 504 so as to be elevated above head level. Supports 123 are positioned at points extending beyond each of end walls 112 of enclosure 110. Understandably, tracks 121 may extend beyond an end of only one of end walls 112 or both and supports 123 may be arranged correspondingly. In this manner, roof panels 124 are afforded a full range of motion along a full length of the frame of the enclosure 110. Further, when the roof panels 124 are in an open position as shown in FIG. 12, for instance, the interior of the enclosure 110 is entirely uncovered and an alternate covered so-called verandah area 227 is created at one or both ends of the structure. Additional horizontal or vertical frame members and wall surfaces may be provided around this verandah area 227 as desired. Accordingly, as will be explained in further detail and is readily understandable, the roof panels 124 may be positioned such that the interior of enclosure 110 is completely uncovered.

Each end 127*a* and 127*b* of the respective roof panel sides 140*a* and 140*b* includes a plurality of roller assemblies (not shown) adapted to movably cooperate with tracks 121*a* and 121*b* respectively to allow the roof panels 124 to move along the tracks 121 between the open and closed positions. The roller assemblies include a rolling element that accommodates the geometry of the tracks 121 and is mounted to the framework of the roof panels 124.

Figure 16:
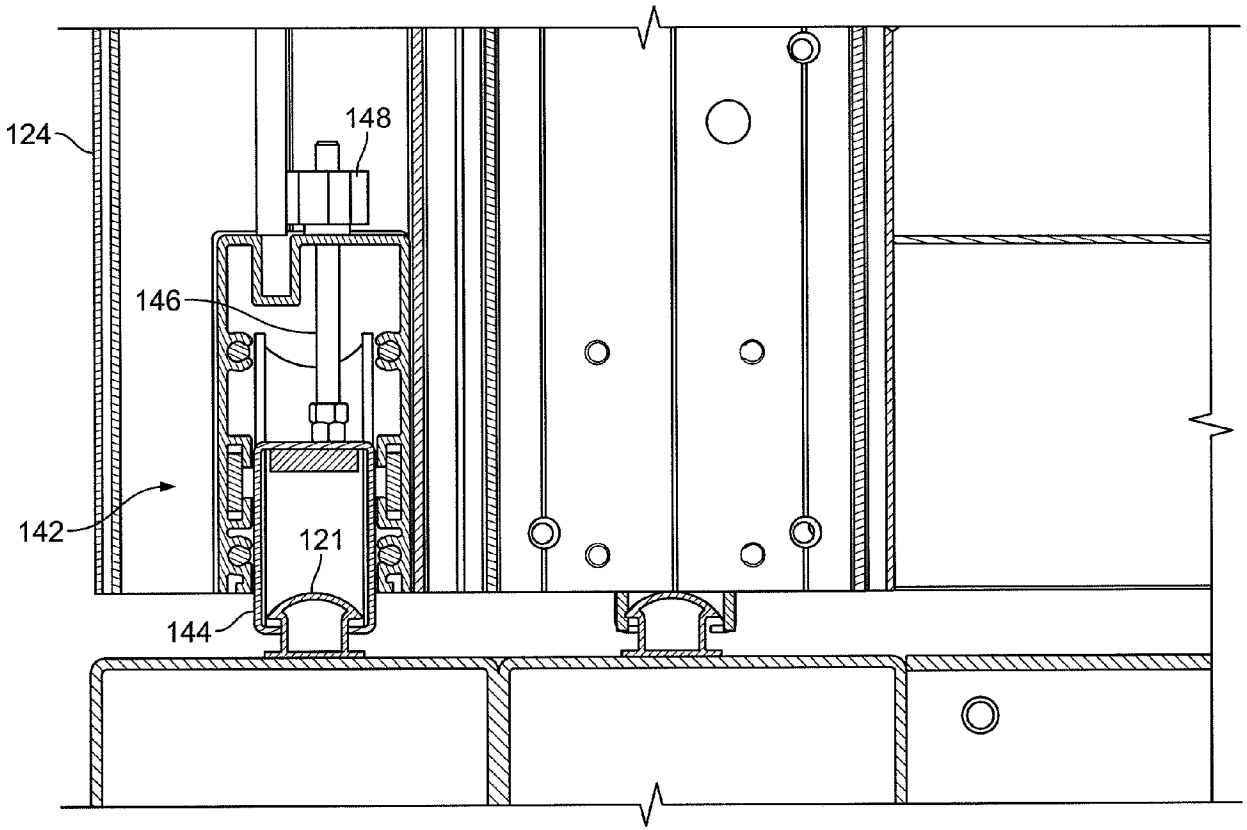
FIG. 16 is a partial cross-section of a roof track and roller assembly according to at least one construction of the present invention.
Figure 17:
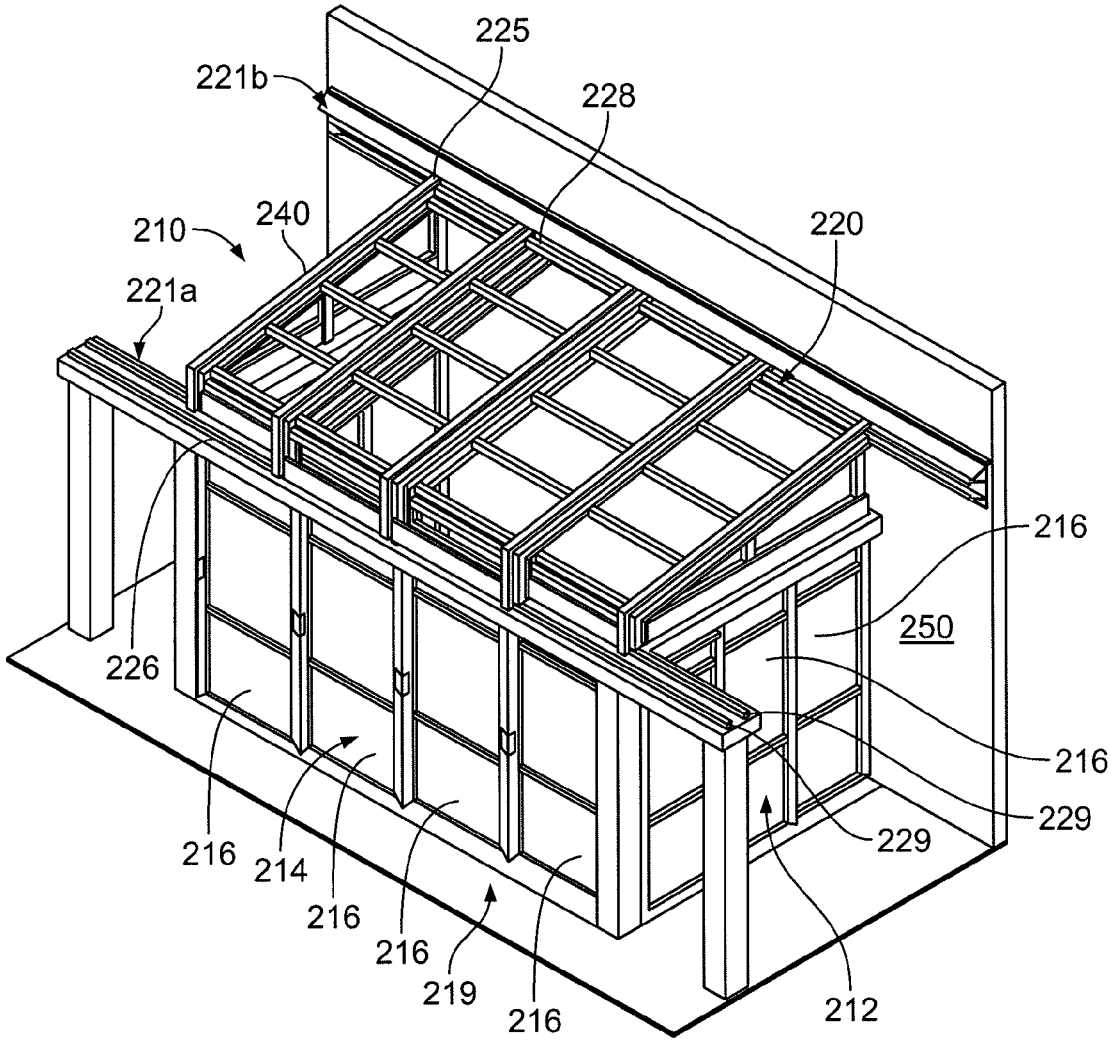
FIG. 17 is a perspective view of a third embodiment of an enclosure according to the present invention shown in a closed configuration.

Referring now to FIG. 16, the tracks 121 may be constructed with features that ensure relatively close alignment between the track 121 and the roller assemblies or with features that ensure a relatively loose alignment therewith. These features ensure that the roof panels 124 move smoothly along the tracks 121. Roof panels 124 may have track clamp assemblies 142 mounted to their framework to prevent the roof panels 124 from moving vertically or laterally off of the tracks 121. These track clamp assemblies 142 may also serve to couple the roof panels 124 to the tracks 121 temporarily or permanently as desired. Tracks 121 may include features such as flanges or grooves configured to interconnect with the track clamp assemblies 142. Track clamp assemblies 142 include a clamping element 144 configured to be received around track 121 Clamping elements 144 may comprise a generally U-shaped cross-section or any other such shape to accommodate the securing of track clamping assembly 142 around track 121. The clamping elements 144 are coupled to a portion of the roof panel 124 by way of a threaded rod 146 that is received through the roof panel 124 and the clamping element 144. The rod 146 may include a knob 148 or similar such element configured to adjust a relative tightness between the clamping element 144 and the roof panel 124 as is generally understood.

In this manner, the roller bearings allow the roof panels 124 to easily move along the tracks 121*a* and 121*b*. In this embodiment, of the present invention, the roof panels 124 and the side panels 118 are configured to operate independently of one another. That is, as desired the user may open or close only the side panels 118 or only the roof panels 124 or may open or close the side panels 118 and roof panels 124 to different degrees. Thus, this results in an enclosure 10 that is highly configurable and adaptable to a number of different environments.

Referring now to FIG. 12 in particular, the enclosure 110 is shown in the open configuration wherein the roof panels 124 are fully opened. In this manner, the area enclosed by the enclosure 110 (i.e., the enclosable space defined within the perimeter outlined side walls and the end walls) is completely exposed to the surrounding elements. Further, as can be appreciated, the roof panels are moved to the ends of tracks 121 such that they do not interfere with the area's exposure to the elements such as, for instance, the sun. Similarly, side panels 118 are shown in their respective open positions such that full ingress and egress is allowed between the interior of enclosure 110 and the surrounding area. As previously discussed, roof panels 124 and side panels 118 may be in any number of intermediate positions or only one of the roof panels 124 and the side panels 118 may be in the open position as desired.

The roof is formed by a plurality of roof sections that are slideable relative to one another. The roof includes two halves each formed by a central roof section 510 and an end roof section 512. Each of the roof sections spans a distance of the enclosure defined between the horizontal side beams 504. The roof sections include frames supporting the roof panels 124 such that the roof panels of each roof section meet at a peak. The peaks define a peak line that corresponds with a slide orientation 515 (i.e., a slide axis) of the roof sections. The slide orientation 515 of the roof sections is depicted as being parallel to the side walls 114 of the enclosure. The end roof sections 512 include the roof panels and an end wall 516 that traverses/covers/blocks an outer end of each end roof section 512. The central roof sections 510 have ends that are open so the central roof sections 510 can slide over the end roof sections 512 when in the open configuration of FIG. 12. When in the open configuration, the central roof sections 510 slide over the end roof sections 512 is a relationship that can be referred to as stacked, nested, telescopic or like terms. In the open configuration of FIG. 12, the roof sections are stacked/nested at a location above a region which is outside the enclosable boundary defined by the frame (e.g., thereby forming a verandah). In the depicted embodiment of FIG. 12, the roof sections do not overhang the enclosable space. In certain embodiments, the stacked roof sections may partially overhang the enclosable space and partially overhang the non-enclosable space when in the open orientation. In still further embodiments, a major portion (e.g., at least half) of each roof section is positioned above the non-enclosable space when the roof sections are stacked/nested in the open orientation. In still other embodiments, the roof sections can be nested at a location that is not offset from the perimeter of the enclosable space. For example, the end roof sections can be fixed in place covering the ends of the enclosed space, and the central roof sections can slide over the fixed end roof sections. To increase the length of the enclosure, more than two roof sections can be provided at each half of the roof.

Each roof section slides along a pair of parallel tracks designated specifically for the given roof section. Each pair of tracks includes a first track mounted on one of the horizontal side beams 504 and a second track mounted on the opposite horizontal side beam. The tracks for the central roof sections are positioned outside the tracks for the end roof sections. The tracks for the central roof sections and the end roof sections can extend beyond the perimeter of the enclosable space of the enclosure.

Figure 11:
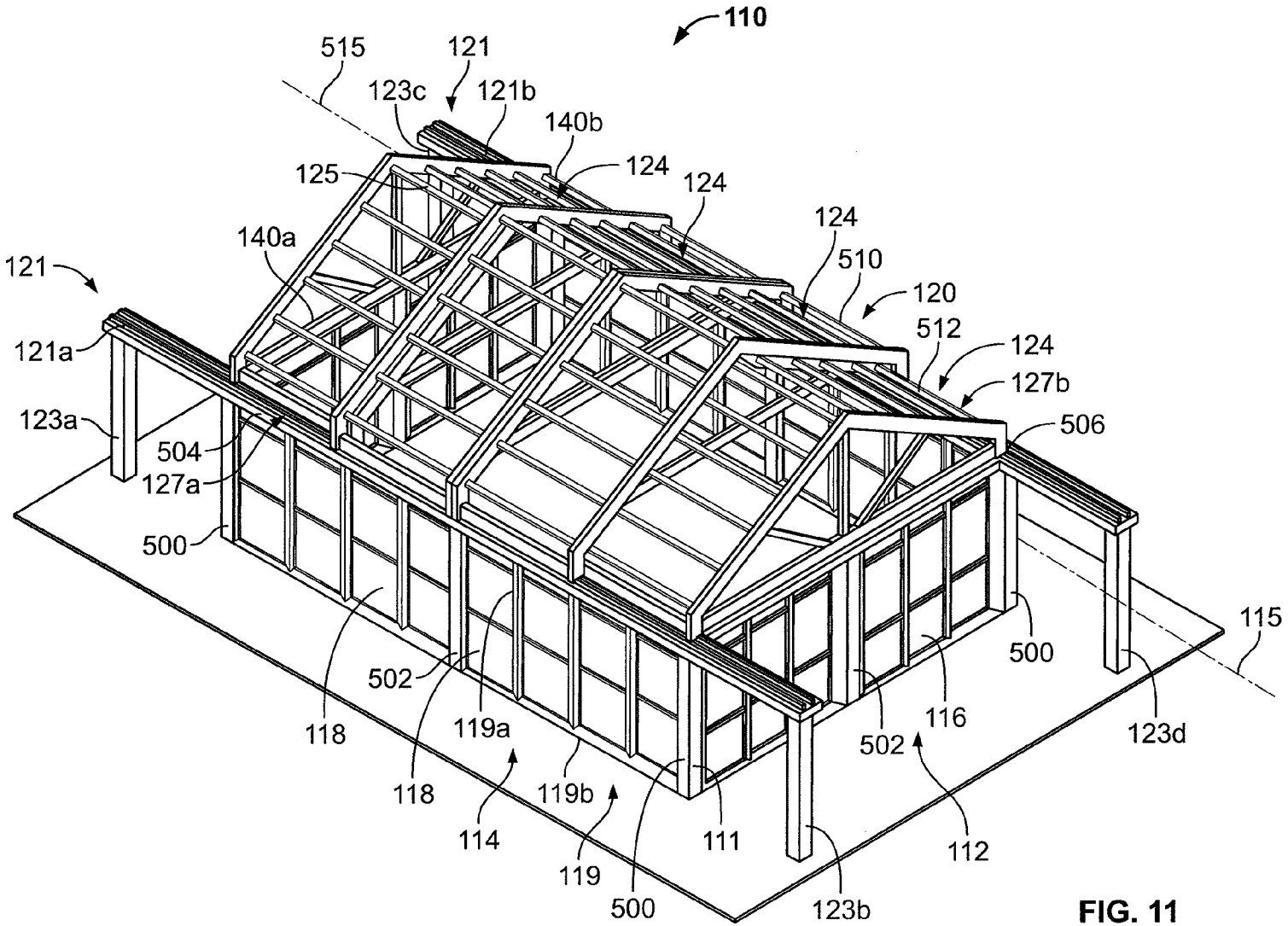
FIG. 11 is a perspective view of a second embodiment an enclosure according to the present invention shown in a closed configuration.

The side panels 118 form convertible walls along the sides of the enclosure. The convertible side walls can be converted between a closed configuration (see FIG. 11) and an open configuration (see FIG. 12). The side panels 118 move along slide orientations that are parallel to the slide orientation 515 of the roof. The roof sections are slideable along separate tracks positioned at top sides of the horizontal side beams 504 and the side panels 118 are slideable along separate tracks (see FIG. 25 in which the panels are hung on separate tracks 321 through the use of rollers 600 captured within tracks 321) mounted at bottom sides of the horizontal side beams 504. As shown at FIG. 11, each side wall is formed by two sets of side panels 118 separated by one of the intermediate posts 502. Each set of side panels 118 includes four panels with each panel of the set slideable along a separate track secured to the underside of the horizontal side beam 504. Each of the four tracks corresponding to the side panels of a given set preferably extends substantially the full distance between the corresponding corner post and the corresponding intermediate post. When in an open configuration, the four panels 118 can be layered one behind the other as shown at FIG. 12. In this configuration, at least 60 percent of the side 114 is open. While the panels are shown stowed adjacent the intermediate post in FIG. 12, the panels can also be stowed adjacent the corner posts or can be layer/stacked at locations between the corner posts and the intermediate posts. Because the side panels 118 slide along tracks that are separate from the tracks used to slide the roof sections, the side walls can be opened and closed independently with regard to the opening and closing of the roof. Thus, for certain weather conditions, the roof can be open and the side walls can be closed. In other weather conditions, the side walls can be open and the roof can be closed. In other embodiments, each set of side wall panels 118 can include more than 4 side wall panels.

The wall panels 116 at the ends 112 of the enclosure form convertible walls along the ends of the enclosure. The convertible end walls can be converted between a closed configuration (see FIG. 11) and an open configuration (see FIG. 12). The end wall panels 116 move along slide orientations that are perpendicular to the slide orientation 515 of the roof. The roof sections are slideable along separate tracks positioned at top sides of the horizontal side beams 504 and the end wall panels 116 are slideable along separate tracks (see FIG. 25 in which the panels are hung on separate tracks 321 through the use of rollers 600 captured within the tracks 321) mounted at bottom sides of the horizontal end beams 506. As shown at FIG. 11, each end wall is formed by two sets of end wall panels 116 separated by one of the intermediate posts 502. Each set of end wall panels include three panels with each panel of the set slideable along a separate track secured to the underside of the horizontal end beam 506. Each of the three tracks corresponding to the end wall panels of a given set preferably extends substantially the full distance between the corresponding corner post and the corresponding intermediate post. When in an open configuration, the three panels 118 can be layered one behind the other. In this orientation, at least 50 percent of the end 112 is open. The panels can be stowed adjacent the corner posts, adjacent the intermediate posts, or can be layer/stacked at locations between the corner posts and the intermediate posts. Because the end wall panels slide along tracks that are separate from the tracks used to slide the roof sections and the side walls, the end walls can be opened and closed independently with regard to the opening and closing of the roof and the side walls. In other embodiments, more or fewer than 3 end wall panels 116 can be used for each set of end wall panels.

Referring again to FIG. 12, the enclosure 110 includes a length L and a width W. Each of the roof sections is sized to span the width W of the enclosure 110. The roof sections are slidably mounted to tracks that are elevated above head level. The roof sections slide in a direction/orientation that extends along the length L of the enclosure. The enclosure includes convertible side walls that extend along the length of the enclosure and convertible end walls that extend along the width of the enclosure. The side walls can be moved between a first configuration where the sides of the enclosure are fully enclosed and a second configuration where the sides of the enclosure are at least 40 percent open, or at least 50 percent open, or at least 60 percent open. Movement of the panels of the side walls between the first and second configurations is in a direction/orientation that extends along the length of the enclosure. The end walls can be moved between a first configuration where the ends of the enclosure are fully enclosed and a second configuration where the ends of the enclosure are at least 40 percent open, or at least 50 percent open. Movement of the panels of the end walls between the first and second configurations is in a direction/orientation that extends along the width of the enclosure. In certain example embodiments, structures as disclosed herein can have a perimeter defining a footprint less than 2000 square feet, or less than 1500 square feet, or less than 1000 square feet. Of course, other embodiments can be larger than 2000 square feet.

Turning now to FIGS. 17-22, another embodiment of the enclosure 210 according the present invention is illustrated. Enclosure 210 of the present embodiment operates in much the same way as the previous embodiment in that the side panels 218 and roof panels 224 are independently movable along separate track assemblies 219 and 221, respectively. In the present embodiment, however, the structure includes only a single sidewall 214 opposite a structural wall 250. Likewise, roof 220 only comprises one side 240 that extends from side 214 across a width of enclosure 210 and peaks at structural wall 250 to define a peak 225. Ends 212 are interconnected between side 214 and structural wall 250 to thereby define an enclosed interior. Structural wall 250 may comprise any number of structures. Again, sidewall 214 and ends 212 may comprise a plurality of entry doors 216 for ingress and egress between the interior of enclosure 210 to an exterior thereof For instance, structural wall 250 may be a side wall of an existing building such as a restaurant. Thus, enclosure 210 cooperates with an existing structure to provide a selectively covered area.

Figure 18:
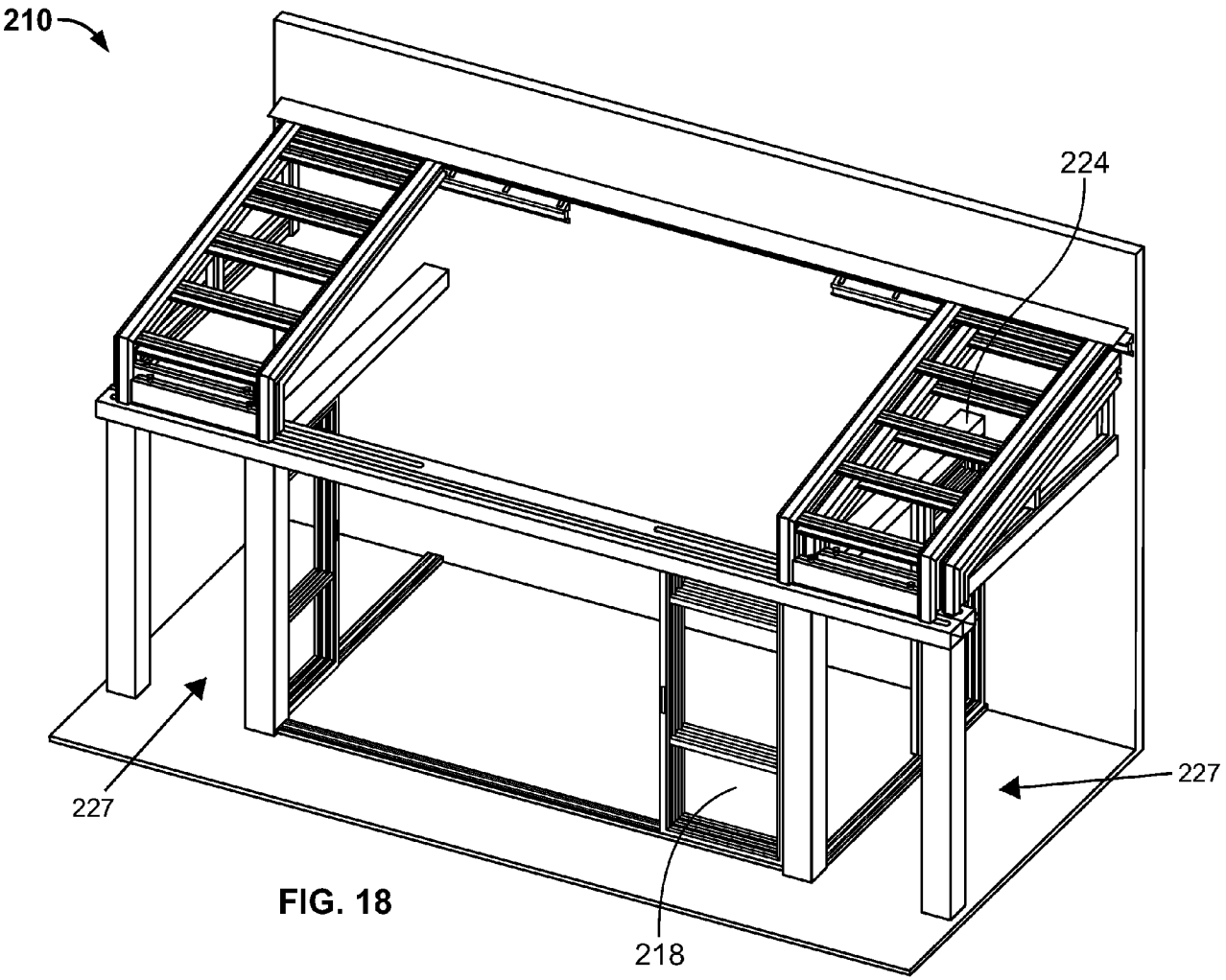
FIG. 18 is a perspective view of the enclosure of FIG. 17 in an open configuration.
Figure 19:
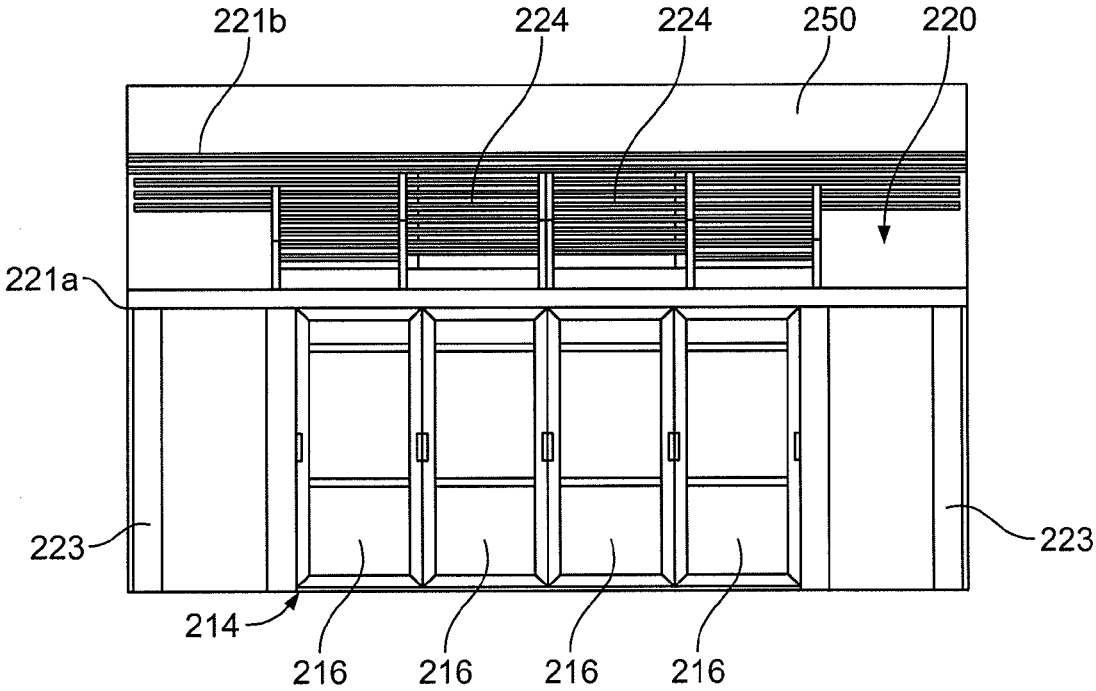
FIG. 19 is side elevation view of the enclosure of FIG. 17.
Figure 20:
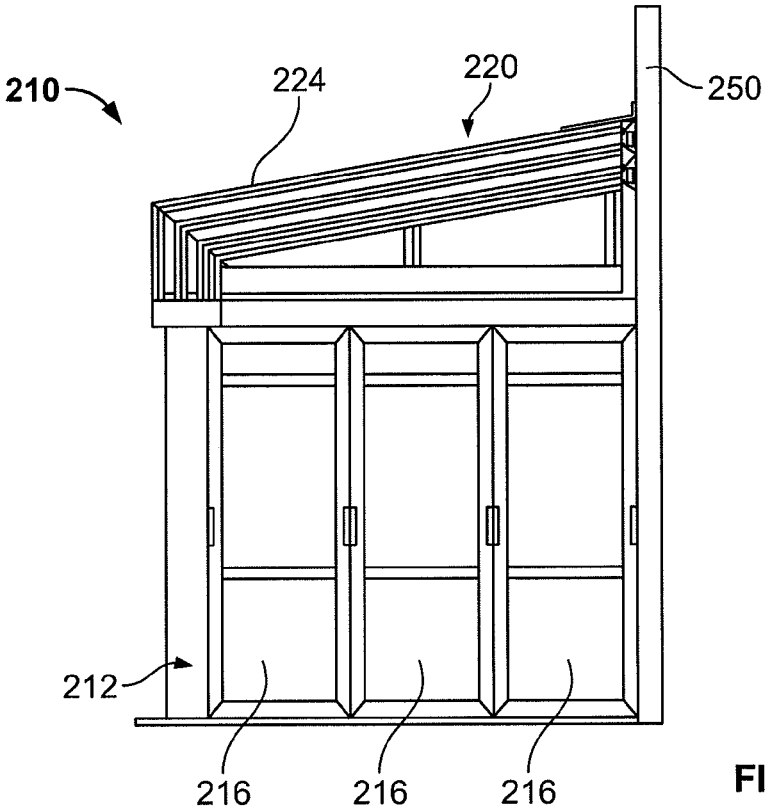
FIG. 20 is an end elevation view of the enclosure of FIG. 17.
Figure 21:
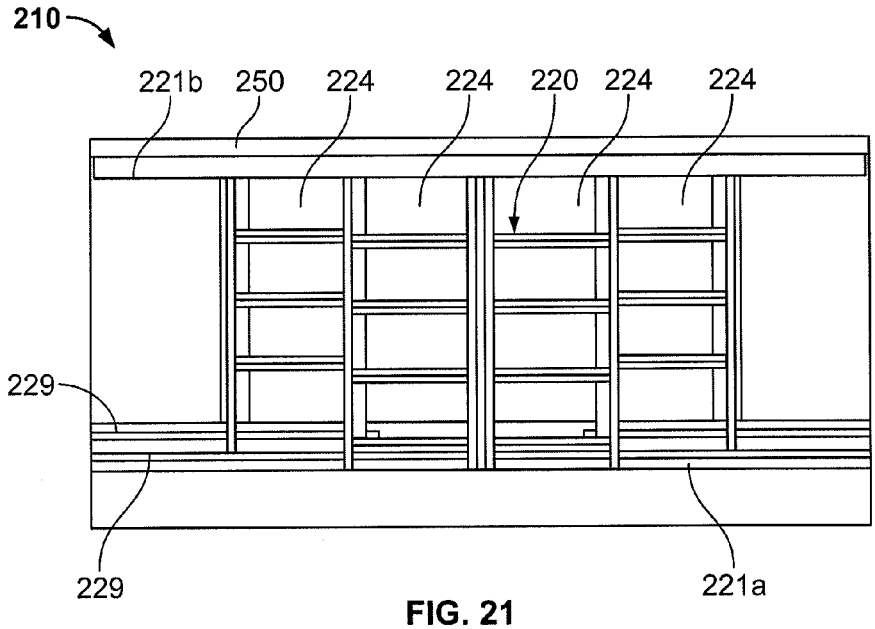
FIG. 21 is a top plan view of the enclosure of FIG. 17.

In the present embodiment, a pair of tracks 221*a* and 221*b* are operably interconnected with roof panels 224. Track 221*a* operates in much the same manner as tracks 121*a* and 121*b* of the previous embodiment. That is, track 221*a* extends a distance greater than the each of the end walls 112 and track 221*a* is supported by a pair of longitudinally spaced vertical supports 123*a* and 123*b*, though any number of vertical supports may be provided in keeping with the spirit of the present invention so long as enough structural support for the track 221*a* is provided to support the weight of roof panels 224. Track 221 may alternatively extend beyond a length of enclosure 210 on only one end thereof. In either case, as discussed previously, such an arrangement enables a full range of motion for the roof panels 224 and may enable the creation of an alternate covered area outside of the area enclosed by enclosure 210 such as a verandah area 227 as best shown in FIG. 18. As in the previous embodiments, additional horizontal or vertical frame members and/or wall support surfaces may be provided for supporting the verandah area 227 as desired. Again, each of roof panels 224 includes a roller assembly (not shown) of the kind generally known in the art at a first end 226 thereof including a plurality of roller bearings adapted to be movably secured between a gap defined by vertically extending rails 229. Track 221*b* is positioned opposite track 221*a* and is mounted to the façade of structural wall 250. Track 221*b* is configured to cooperate with a second roller assembly (not shown) provided at a second end 228 of each of the roof panels 224. Each roller assembly includes a plurality of individual roller bearings mounted at the second end 228 of roof panel 224. Each of the roller bearings is configured to cooperate with track 221*b*. Track 221*b* includes a pair of rails 229 extending horizontally therefrom to define a gap therebetween for receiving the roller bearings of the second roller assembly. In this manner, the roof panels 224 are movable along track 221*b* in much the same way that the roof panels 224 are movable along track 221*a*. As in the previous embodiment, roof panels 224 and side panels 118 are configured for independent operation such that one of the roof panels 224 and the side panels 118 may be opened or closed or such that they may be opened or closed to varying degrees.

Referring now to FIG. 18 in particular, enclosure 210 is shown in its open position wherein the roof panels 224 and the side panels 218 are all in their respective open positions. As may be readily understood, the roof panels 224 and side panels 218 may be configured to be in any number of intermediate positions or enclosure 210 may be configured such that only one of the roof panels 224 and the side panels 218 are in the open position as may be desired.

Figure 22:
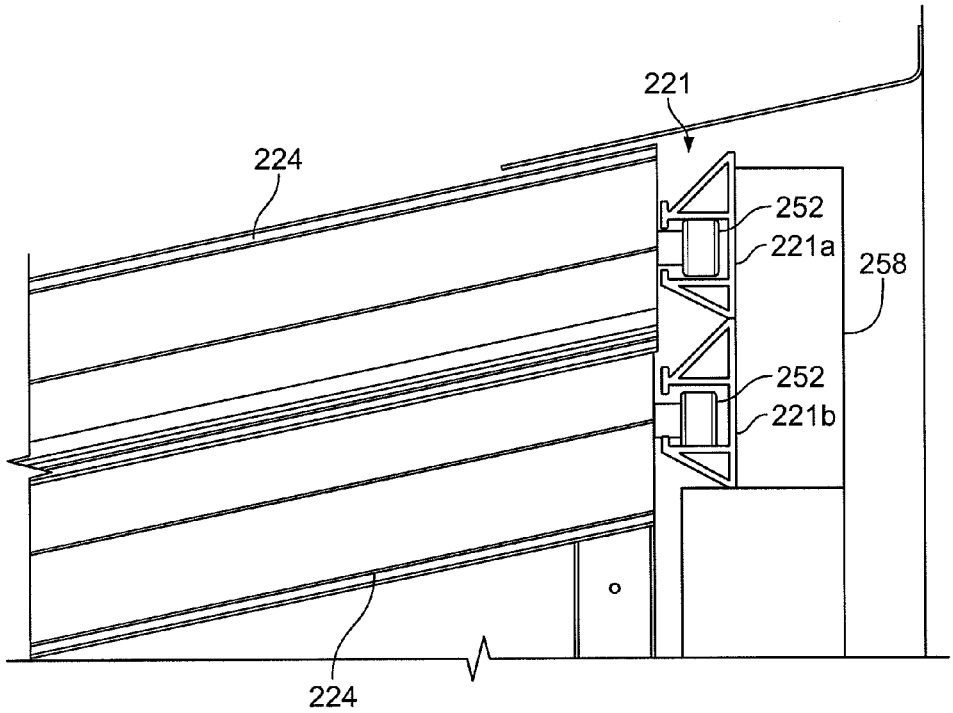
FIG. 22 is a side view of the enclosure of FIG. 17 illustrating a wall-mounted track assembly.

Turning now to FIG. 22, a construction of track assembly 221 mounted to a structural wall is illustrated. As illustrated, enclosure 210 includes a pair of tracks 221*a* and 221*b* interconnected with a pair of corresponding rollers 252. Rollers 252 are secured to the roof panels 224 by way of a nut or similar such element. A washer may be additionally included for spacing the nut from the roof panel 224. Tracks 221 define a path of travel for rollers 252 and are mounted to a support structure 258. Support structure 258 may include one or more support elements constructed out of wood, steel, or similar such materials capable of providing support to the track assemblies 221. It is understood that enclosure 210 according to the present construction may be devoid of such support structures 258 and tracks 221*a* and 221*b* may be mounted directly to a structural wall of an existing building to which the enclosure is being added.

Referring to the embodiment of FIGS. 17-22, the enclosure 210 includes a fixed structural frame defining an enclosable region and verandah regions 227. The verandah regions 227 are located at opposite ends of the enclosable region. The fixed structural frame defines a perimeter or outer boundary around the enclosable region, and can include a plurality of vertical posts and horizontal supports. The tracks 219, 221 can be supported by the fixed structural frame. The fixed structural frame also defines overhangs that project outwardly from the perimeter of the enclosable region and define verandah regions 227. The roof panels 224 are movable between a closed configuration (see FIG. 17) and an open configuration (see FIG. 18). In the closed configuration, the roof panels 224 are positioned over the enclosable region such that the enclosable region is covered and protected. In the open configuration, at least portions of the roof panels 224 are outwardly offset from the enclosable region so as to be positioned outside the perimeter of the enclosable region. For example, as shown at FIG. 18, the roof panels 224 are shown stacked on the overhangs at the verandah regions 227 at positions outside the perimeter of the enclosable region. In this way, the enclosable region is completely uncovered and available for outside seating or other outdoor activities. In certain embodiments, the space above the enclosable region is at least 40, 50, 60, 70, 80, 90 or 100 percent open when the roof panels 224 are in the open configuration. In certain embodiments, when in the open configuration, the roof panels 224 are arranged in a stack with at least a portion of the stack offset from the enclosable region and forming the verandah 227 outside the enclosable space. In other embodiments, when in the open position, the roof panels 224 are arranged in a stack with a majority of the stack offset from the enclosable region and forming the verandah 227 outside the enclosable space. In still other embodiments, when in the open position, the roof panels are arranged in a stack with the stack completely offset from the enclosable region and forming the verandah 227 outside the enclosable space.

The panels 218, 224 are movable relative to the fixed frame structure and each includes a frame supporting one or more light transmissible components (e.g., transparent or translucent components) such as window panes. The roof panels 224 are independently movable relative to the panels 218 of the side 214. The roof panels 224 are also independently movable relative to the panels 216 of both ends 212. The panels 218 of the side 214 are movable between a closed configuration and an open configuration. When in the open configuration, the panels 18 of the side 214 overlap one another and the side 214 is at least 70 percent open. The panels 216 of the ends 212 are movable between closed configurations and open configurations. When in the open configuration, the panels 216 of each end overlap one another and the ends 212 are at least 60 percent open.

Enclosure 210 may further include one or more water management elements 262 configured to prevent ingress of water into the enclosure 210. Water management elements 262 may be flashing such as a piece of sheet metal or other such material configured to overhang the tracks 221 of enclosure 210 so that water rolls downwardly along the water management element 262 and away from enclosure 210. Enclosure 210 may include a number of water management elements 262 along the entire length thereof. Further, each of the tracks 221 may include its own piece or pieces of flashing.

Figure 23:
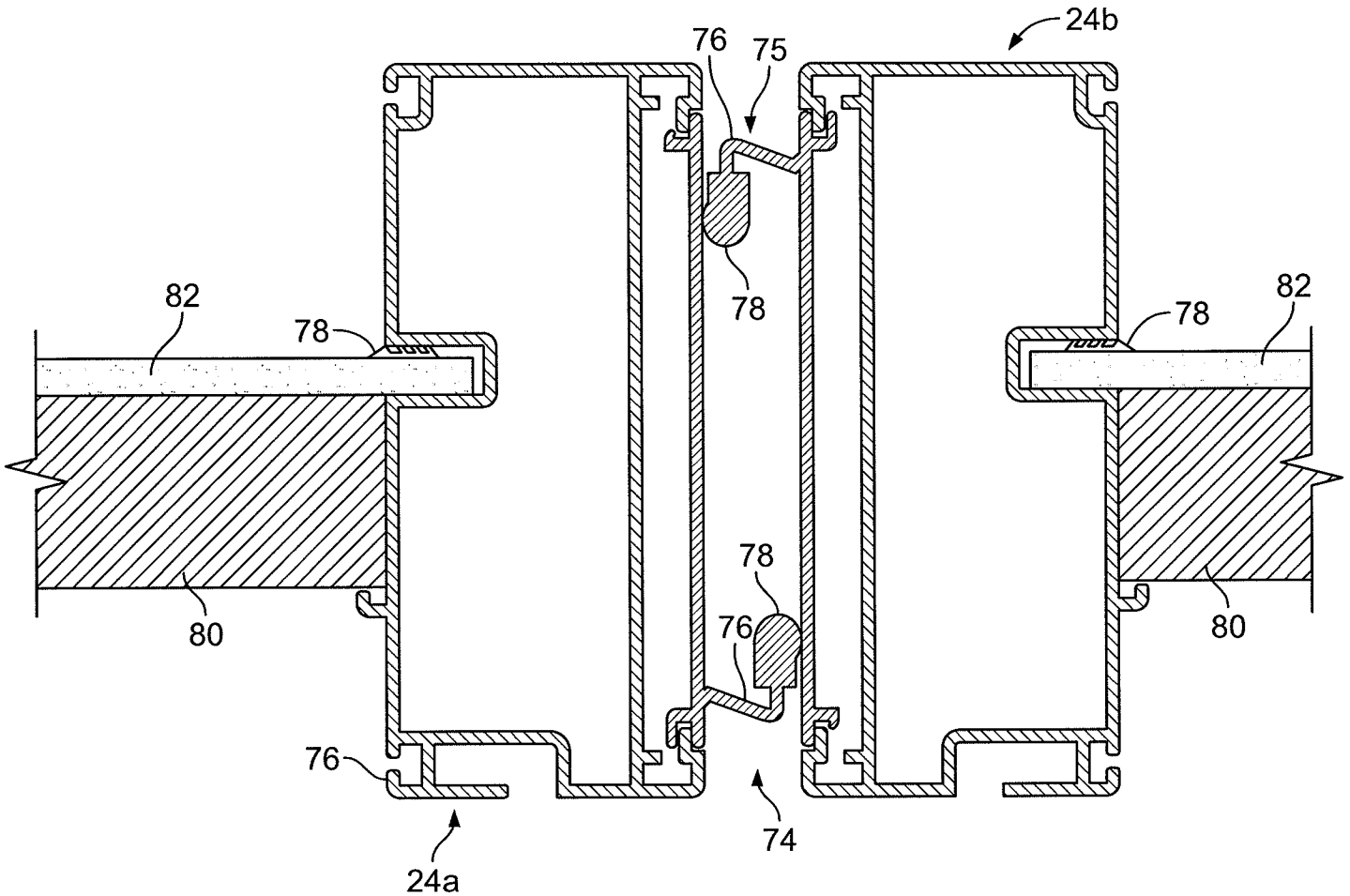
FIG. 23 is a cross-section view of one construction of an enclosure according to the present invention illustrating a water management system.

Referring now to FIG. 23, an illustration of the interconnection or joint 74 between a pair of abutting roof panels 24*a* and 24*b* is provided. The roof panels 24*a* and 24*b* are shown as a pair of roof panels 24 disposed at a lateral center of an enclosure 10 that move toward one another and adjoin to one another as the enclosure 10 is moved to its closed position. The joint 74 may include a weather sealing and water management system 75 incorporated therewith. The system 74 may comprise one or more gutters 76 incorporated into the framework of the roof panels 24. The gutters 76 may overlap one another when the roof panels 24 are in their closed position and may include additional weather sealing components such as, for example, rubber seals or gaskets 78 configured to prevent ingress of water into the interior enclosed by the enclosure 10. Gaskets 78 may be provided at a number of locations within the joint 74 or therearound including between the adjacent and abutting roof panels 24*a* and 24*b* as well as between a horizontal roof brace support 80 and the segments 24*a* and 24*b*. More particularly, the gaskets 78 may be provided between a piece of paneling 82 supported by support 80 and the segments 24*a* and 24*b*. The gutters 76 can pitch away from a peak of the roof and can drain into further gutters or downspouts (e.g., water management assembly 366 of FIG. 25) provided at the sides of the enclosure. It is understood that any of the preceding embodiments discussed herein may include such a construction.

Figure 24:
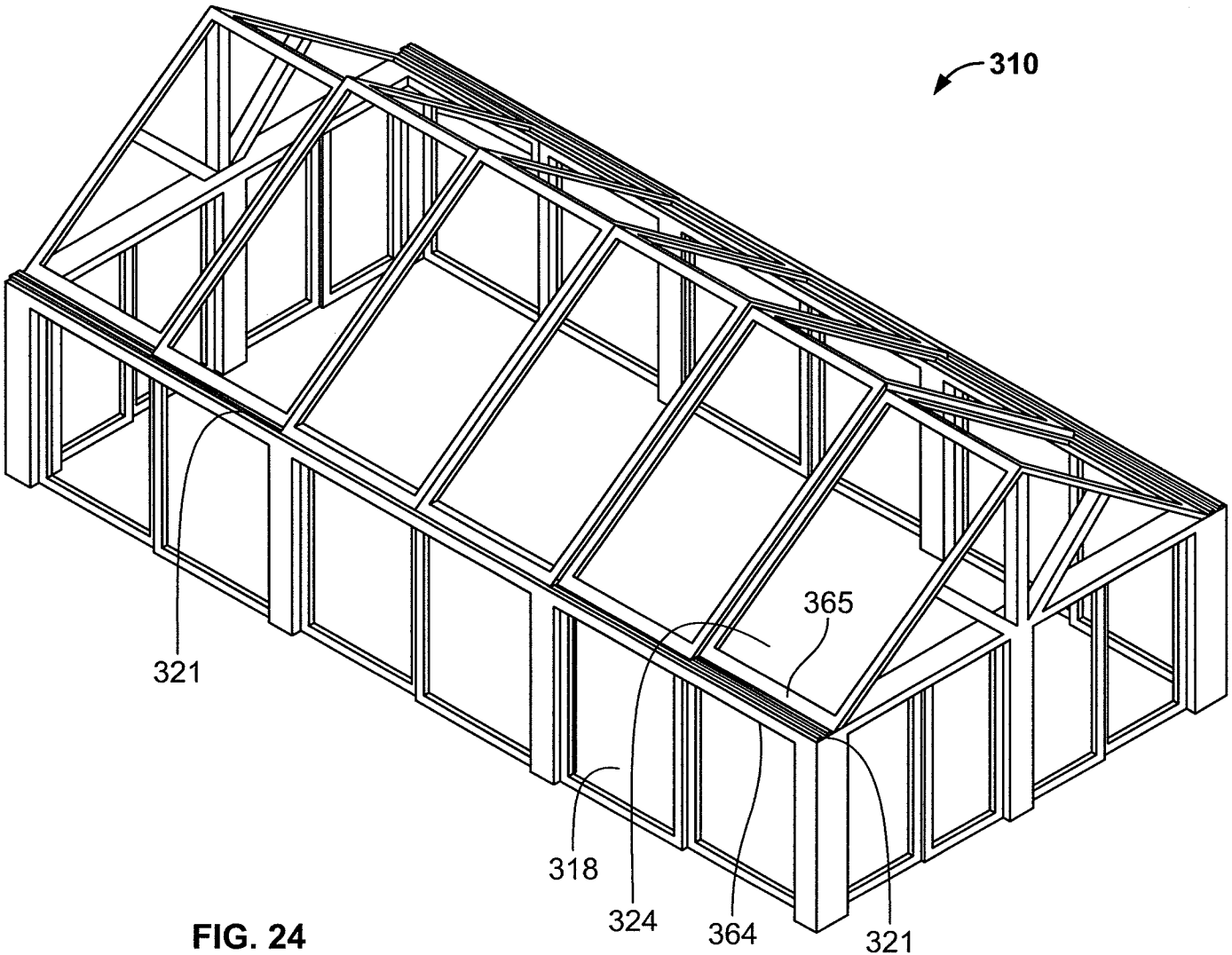
FIG. 24 is an isometric view of an enclosure according to yet another construction according to the present invention.

Referring now to FIG. 24, an enclosure 310 according to another construction of the present invention includes a variable width header beam 364 may be provided for supporting the roof panels 324. In the present construction of enclosure 310, the roof panels 324 and side panels 318 are configured for independent movement with respect to one another. In this manner, the roof panels 324 may be opened while the side panels 318 remain closed or vice versa. Of course, any number of combinations of open and closed arrangements with respect to the roof panels 324 and side panels 318 are possible in the present embodiment. Because the roof panels 324 overlap and stack when in the retracted or closed position, the tracks 321 of adjacent overlapping panels 324 will mount side-by-side along the width of the header beam 364. Accordingly, the width of header beam 364 must be sufficient to accommodate the number of tracks 321 necessary for the given construction of enclosure 310. As discussed, certain roof panels 324 do not necessitate a track 321 as they are stationary. In such cases, a portion of the header beam 364 that supports track 321 need not include a track 321 for the non-moving roof panels 324; accordingly, the header beam 364 may comprise a first width configured to support the appropriate number of tracks 321 for a given structure over the length of the enclosure over which the movable roof panels 324 are meant to move, but header beam 364 may include an increased width over the area identified as 365 and occupied by the non-moving roof panels 324 for support thereof. In this manner, the header beam 364 maintains a relatively slim profile over a majority of the length of the enclosure 310 while still providing ample support for the non-moving roof panels 324.

Turning now to FIG. 25, in yet another construction of the enclosure 310 of the present embodiment, a water management assembly 366 may be provided. In cases where the roof panels 324 and the side panels 318 move independently and the roof panels 324 are supported by horizontal beams such as header beam 364, water management assembly 366 may be provided to further prevent the ingress of water and the like from entering enclosure 310. Understandably, the side panels 318 will typically be mounted above and/or below in guide tracks 321 that support the weight of the panels and/or guide their motion. In some cases, traditional sloped gutters may be used along the exterior faces of the header beams to minimize the amount of water that flows down onto the side panels 318. In other instances, sealants, adhesives, and water stripping such as brush seals and/or rubber gaskets may be used to seal the joints and spaces between the header beams, the guide tracks and the side panels 318. In other instances, guide tracks supporting the side panels 318 from above may include drip edges that catch all of the water running down the header and force it to fall to the ground before it can reach the surfaces of the side panels 318.

Figure 26:
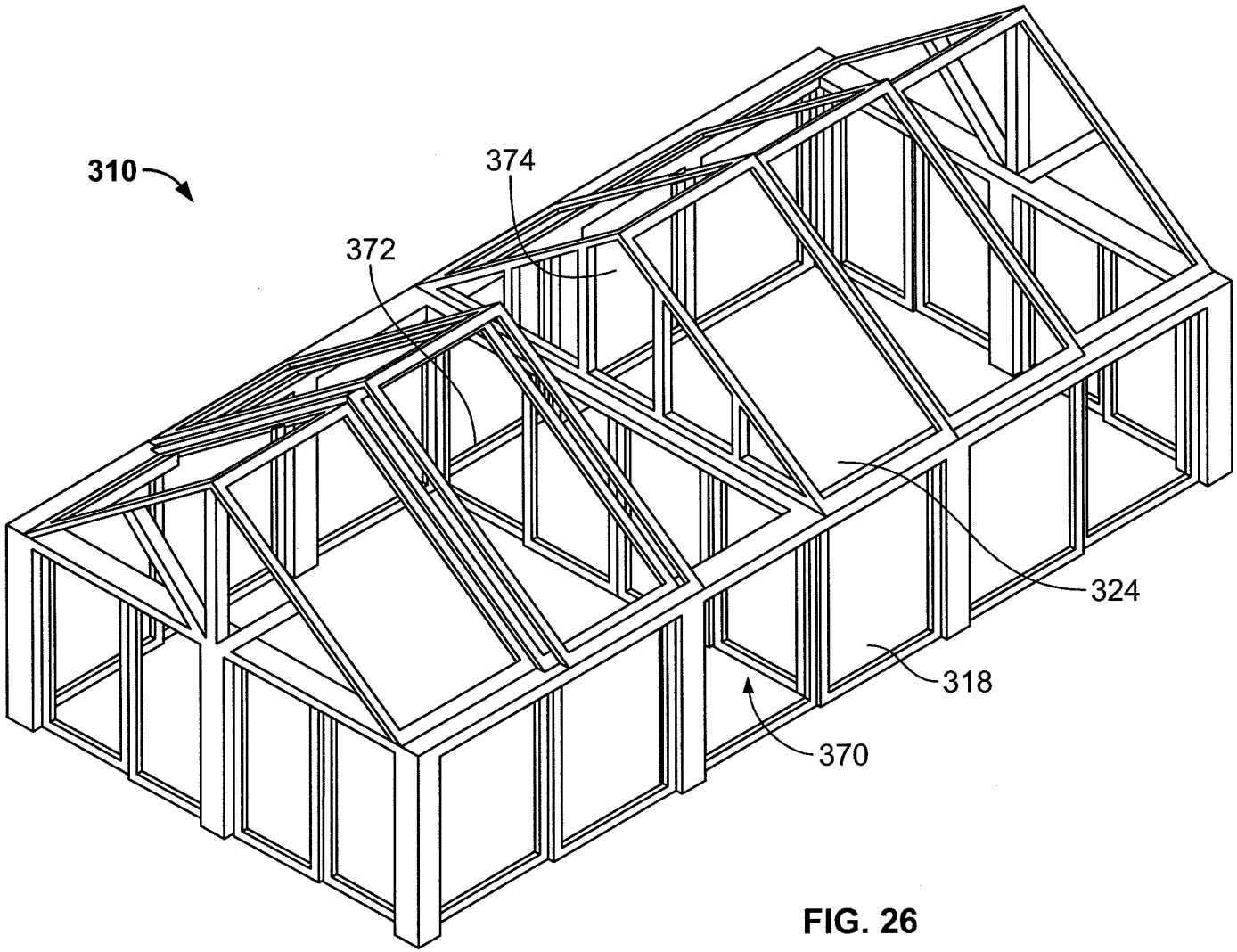
FIG. 26 is an isometric view of an enclosure according to one construction of the present invention incorporating an interior wall.

Referring to FIG. 26, in yet another construction of the enclosure 310, one or more interior walls 370 may be provided to define a number of rooms within the interior of the enclosure 310. The interior walls 370 may extend across the width or length of the enclosure 310. The one or more interior walls may divide the enclosure 310 in half or may create two or more differently sized spaces or rooms within the interior. In some cases, the one or more interior walls 370 may extend only up to the height of the eaves incorporated into the sliding wall panels. In other cases, the wall may extend over the entire height of the enclosure 310. The one or more interior walls may include one or more pieces. In one exemplary embodiment, the interior walls 370 include a lower part 372 constructed of a sliding wall panel and an upper part 374 incorporated into the overhead sliding roof panels in such a way that the sliding roof panels 324 can be moved into a position that forms a continuous interior wall 370 from the peak of the roof to the floor when the lower interior wall panels are closed.

Enclosures 10, 110, 210, and 310 (collectively, enclosures 10) according to the present invention may include a number of enhancements to improve the usability of the space to be enclosed thereby. For instance, enclosure 10 may include a plurality of lighting sources secured thereto. For instance, lighting may be recessed or otherwise provided for within the segments of the frame 11 in the form of a lighting bar or other such illumination member. Further, enclosure 10 is preferably wired for electricity to power the lighting and other installed features such as, for example, appliances, ceiling fans, electronics, stereo equipment, televisions, stereos, etc. The members of frame 11 preferably include snap on trim for routing and otherwise hiding the electrical and audio/visual wiring from view to improve the aesthetic appearance of the enclosure 10 and to protect the wiring from the elements and or other damage. Enclosure 10 may include a number o other optional enhancements such as a built-in bar, locker and/or storage areas, lofted areas, eve overhangs that are removable prior to opening of the enclosure 10, a stage, drape bars to support drapes or other window coverings to enhance privacy for the users of the enclosure 10, chimney or other ventilation system for allowing of the venting of smoke from cigarette smoking and/or a fire pit or grill, and aluminum lattice for hanging of vines and/or other vegetation. The drapes or other window coverings may be incorporated into the track and roller system such that they are independently movable along the tracks in a similar fashion as the panels as previously discussed. Alternatively, the drapes may be integrated into the panels themselves as is generally understood. In another embodiment, the drapes are sail shades that open as the enclosure 10 opens to shade the open area of the enclosure. Likewise, an insect screen may be mounted to the enclosure in a similar fashion as the drapes. Enclosure 10 may be additionally fitted with a sprinkler system for watering plants or extinguishing a fire.

It is understood that a number of modifications may be made in keeping with the spirit of the enclosure 10 of the present invention. For example, the enclosure 10 may include a retracting screening system (not shown). The retracting screening system is preferably independently operable with respect to the side panels 18 and roof panels 24. The retracting screening system operates similarly to the side panels 18 and roof panels. Preferably, the retracting screening system is selectively movable from a deployed position and a collapsed position as well as a plurality of intermediate positions therebetween. As such, the operator of enclosure 10 may selectively screen in the area while collapsing the side panels 18 and roof panels 24 such that the area is open to the environment while keeping out insects and animals while maintaining a relatively private enclosure. Likewise, side panels 18 and roof panels 24 may comprise a mesh construction to provide a screened-in enclosure. Alternatively, side panels 18 and roof panels 24 may include a mesh screen in addition to a polycarbonate or glass panel such that the panels may be selectively opened and closed while keeping out insects and the like. In a preferred embodiment, enclosure 10 includes one screened window per every 200 feet; however, it can be appreciated that any number of alternative configurations may be used as desired. A number of custom window options are contemplated and may be incorporated with the side panels 18 of the present invention. For instance, simulated dividing lights (not shown) may be included. These lights may be screwed or otherwise fastened through the panels to attach to the tracks to thereby hold or otherwise secure a snap on mullion.

Further, enclosure 10 may be fitted with another independent auxiliary track (not shown). The auxiliary track is preferably configured for selectively moving objects within the area enclosed by enclosure 10. For example, the furniture, i.e., tables, seats, etc. may be coupled to the auxiliary track for movement along the track. As such, the positioning of the furniture within the enclosure 10 may be easily and selectively configured.

It is specifically intended that the present invention not be limited to the embodiments and illustrations contained herein, but include modified forms of those embodiments including portions of the embodiments and combinations of elements of different embodiments as come within the scope of the following claim.

The invention claimed is:

1. A building structure comprising:

a fixed structural frame defining an enclosable region having a perimeter defined by a length and a width, the fixed structural frame including a horizontal side beam supported by vertical posts, the horizontal side beam extending along the length of the enclosable region, the enclosable region including a first end separated from a second end by the length of the enclosable region, the enclosable region also having a side that extends along the length of the enclosable region between the first and second ends;

a convertible roof including a plurality of roof sections that each span the width of the enclosable region, the plurality of roof sections including movable roof sections that are slidably mounted to roof tracks, the roof tracks being elevated above head level and mounted to the horizontal side beam, the convertible roof being convertible between an open configuration and a closed configuration, the movable roof sections being movable relative to the fixed structural frame along the roof tracks to convert the convertible roof between the open configuration and the closed configuration, at least two of the roof sections substantially overlapping one another when the convertible roof is in the open configuration, and the enclosable region being at least 40 percent uncovered when the roof sections are in the open configuration;

a convertible side wall provided at the side of the enclosable region, the convertible side wall being convertible between an open configuration and a closed configuration, the convertible side wall including a plurality of side wall sections, the plurality of side wall sections including movable side wall sections that are slidably mounted to side wall tracks that extend in a direction along the length of the enclosable region, the side wall tracks being mounted to the horizontal side beam, the movable side wall sections being movable along the side wall tracks independent of the roof sections, the side wall sections being movable relative to the fixed structural frame along the side wall tracks to convert the convertible side wall between the open configuration and the closed configuration, at least two of the side wall sections substantially overlapping one another when the convertible side wall is in the open configuration, and the side of the enclosable region being at least 40 percent open when the convertible side wall is in the open configuration; and a convertible end wall provided at the first end of the enclosable region, the convertible end wall being convertible between an open configuration and a closed configuration, the convertible end wall including a plurality of end wall sections, the plurality of end wall sections including movable end wall sections that are slidably mounted to end wall tracks that extend in a direction along the width of the enclosable region, the movable end wall sections being movable along the end wall tracks independent of the roof sections and the side wall sections, the end wall sections being movable relative to the fixed structural frame along the end wall tracks to convert the convertible end wall between the open configuration and the closed configuration, at least two of the end wall sections substantially overlapping one another when the convertible end wall is in the open configuration, and the first end of the enclosable region being at least 40 percent open when the convertible end wall is in the open configuration; and the roof sections forming a stack when the convertible roof is in the open configuration, and at least a portion of the stack being positioned outside the perimeter of the enclosable region.

2. The building structure of claim 1, wherein a space above the enclosable region is at least 70 percent open when the convertible roof is in the open configuration.

3. The building structure of claim 1, wherein a space above the enclosable region is at least 80 percent open when the convertible roof is in the open configuration.

4. The building structure of claim 1, wherein a space above the enclosable region is at least 90 percent open when the convertible roof is in the open configuration.

5. The building structure of claim 1, wherein a space above the enclosable region is 100 percent open when the convertible roof is in the open configuration.

6. The building structure of claim 1, wherein the fixed structural frame defines an overhang portion positioned over an outside location, and wherein the portion of the stack outside the perimeter of the enclosable region is supported on the overhang portion to form a verandah outside the enclosable region.

7. The building structure of claim 1, wherein at least a majority of the stack is positioned outside the perimeter of the enclosable region.

8. The building structure of claim 7, wherein the fixed structural frame defines an overhang portion positioned over an outside location, and wherein the majority of the stack outside the perimeter of the enclosable region is supported on the overhang portion to form a verandah outside the enclosable region.

* * * * *